US006625409B2

(12) United States Patent
Shakuto et al.

(10) Patent No.: US 6,625,409 B2
(45) Date of Patent: Sep. 23, 2003

(54) IMAGE FORMING APPARATUS HAVING A DIAMOND-LIKE STRUCTURE SURFACE PROTECTION LAYER ON A PHOTOCONDUCTIVE LAYER

(75) Inventors: Masahiko Shakuto, Kanagawa (JP); Kei Yasutomi, Kanagawa (JP); Hirokatsu Suzuki, Chiba (JP); Nobutaka Takeuchi, Kanagawa (JP); Toshihiko Baba, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/279,901

(22) Filed: Oct. 25, 2002

(65) Prior Publication Data

US 2003/0049050 A1 Mar. 13, 2003

Related U.S. Application Data

(60) Continuation of application No. 10/028,769, filed on Dec. 28, 2001, now abandoned, which is a division of application No. 09/662,701, filed on Sep. 15, 2000, now Pat. No. 6,366,751.

(30) Foreign Application Priority Data

Sep. 17, 1999 (JP) ..... 11-263035
Nov. 25, 1999 (JP) ..... 11-334582
Aug. 24, 2000 (JP) ..... 2000-253876

(51) Int. Cl.[7] ..... G03G 15/00
(52) U.S. Cl. ..... 399/159
(58) Field of Search ..... 399/175, 149, 399/150, 159

(56) References Cited

U.S. PATENT DOCUMENTS 3,635,705 A 1/1972 Ciuffini
5,168,023 A * 12/1992 Mitani et al.
5,357,323 A * 10/1994 Haneda et al. ..... 399/175
5,592,264 A * 1/1997 Shigeta et al. ..... 399/175
5,656,406 A * 8/1997 Ikuno et al.
5,724,632 A * 3/1998 Arahira et al. ..... 399/175
5,797,072 A * 8/1998 Ehara et al. ..... 399/175
5,799,233 A * 8/1998 Ishii et al. ..... 399/175
5,840,455 A * 11/1998 Ikuno et al.
5,870,657 A 2/1999 Nagame et al.
5,890,037 A * 3/1999 Kukimoto et al. ..... 399/175
5,999,773 A 12/1999 Yasutomi et al.
6,052,545 A * 4/2000 Komiya et al. ..... 399/149

FOREIGN PATENT DOCUMENTS

JP 62-63939 * 3/1987
JP 62-212662 * 9/1987
JP 06230652 8/1994
JP 6-258856 * 9/1994
JP 07168385 7/1995
JP 07239565 9/1995
JP 8-69149 3/1996
JP 09211978 8/1997
JP 09329938 12/1997
JP 11072934 3/1999
JP 11149204 6/1999

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus including an image carrier having a conductive support, at least a photoconductive layer formed on the conductive support, and a surface protection layer formed on the photoconductive layer and including a charge injection layer. Also included is a charging member for charging the image carrier in contact with the surface protection layer when applied with a voltage, and a developing unit for developing a latent image formed on the image carrier with toner to thereby produce a corresponding toner image. Further, the surface protection layer has a diamond-like carbon structure or an amorphous structure containing hydrogen, the developing unit develops the latent image with a magnet brush formed by magnetic particles for development, and the charging member includes magnetic particles for charging having a mean particle size smaller than a mean particle size of the magnetic particles for development. Also, the surface protection layer has a volume resistance of $10^9$ Ω·cm to $10^{12}$ Ω·cm and a Knoop hardness of 400 kg/mm$^2$ or greater, and a light transmission of the surface protective layer is 50% or more of a wavelength of light used for exposing the image carrier.

24 Claims, 12 Drawing Sheets

| EXAMPLE 1 | | | EXAMPLE 2 |
|---|---|---|---|
| X | : | 100mm/sec | SAME AS LEFT |
| W | : | 1mm | SAME AS LEFT |
| $V_1$ | : | −1000V | SAME AS LEFT |
| $T_1$ | : | 5$\mu$m | SAME AS LEFT |
| $\varepsilon_1$ | : | 3 | SAME AS LEFT |
| $C_2$ | : | 100PF/cm$^2$ | SAME AS LEFT |
| R | : | $10^{10}$ Ω•cm | $10^{11}$ Ω•cm |
| V | : | −960V | −270V |

*Fig. 7*

| THICKNESS OF CHARGE HOLDING LAYER (μm) | DRUM POTENTIAL (V) | FIELD STRENGTH (V/μm) | BACKGROUND CONTAMINATION | THIN LINE REPRODUCIBILITY |
|---|---|---|---|---|
| 5 | 900 | 180.0 | | |
| | 600 | 120.0 | | |
| 10 | 900 | 90.0 | | |
| | 600 | 60.0 | × | ○ |
| 15 | 900 | 60.0 | × | ○ |
| | 600 | 40.0 | ○ | ○ |
| 20 | 900 | 45.0 | × | ○ |
| | 600 | 30.0 | ○ | ○ |
| 30 | 900 | 30.0 | ○ | ○ |
| | 600 | 20.0 | ○ | ○ |
| 40 | 900 | 22.5 | ○ | △ |
| | 600 | 15.0 | ○ | △ |
| 50 | 900 | 18.0 | ○ | × |
| | 600 | 12.0 | ○ | × |

Fig. 17

| MEAN PARTICLE SIZE (μm) | DOT (2-LEVEL) | SCATTERING OF PARTICLE |
|---|---|---|
| 15 | ○ | × |
| 20 | ○ | ○ |
| 30 | ○ | ○ |
| 50 | ○ | ○ |
| 75 | ○ | ○ |
| 90 | ○ | ○ |
| 100 | ○ | ○ |
| 115 | ○ | ○ |
| 150 | ○ | ○ |
| 200 | × | ○ |

Fig. 18

| MEAN PARTICLE SIZE (μm) | MULTI-LEVEL WRITING |
|---|---|
| 15 | ○ |
| 20 | ○ |
| 30 | ○ |
| 50 | ○ |
| 75 | × |
| 90 | × |
| 100 | × |
| 115 | × |
| 150 | × |
| 200 | × |

IMAGE FORMING APPARATUS HAVING A DIAMOND-LIKE STRUCTURE SURFACE PROTECTION LAYER ON A PHOTOCONDUCTIVE LAYER

The present application is a continuation application of application Ser. No. 10/028,769, filed Dec. 28, 2001 now abandoned, which is a divisional application of application Ser. No. 09/662,701, filed Sep. 15, 2000 now U.S. Pat. No. 6,366,751.

BACKGROUND OF THE INVENTION

The present invention relates to an image forming apparatus for executing an electrophotographic copying process. More particularly, the present invention relates to an image forming apparatus capable of preserving the wear resistance of a photoconductive element or image carrier thereof, image reproducibility and image quality despite a repeated charging process and a repeated developing process.

A problem with a photoconductive element included in an image forming apparatus is that the chargeability of the element is lowered due to repeated operation and, in turn, deteriorates image characteristics. The deterioration of image characteristics include background contamination particular to a reversal development system. Specifically, when toner contained in a developer is charged to polarity opposite to expected polarity, it deposits on the unexposed portion of the photoconductive element (white area in the case of a positive image) and thereby contaminates the background of the element. Further, the toner deposits even on the defective charged portions of the white area during development, appearing as fine black dots in the resulting image. This is particularly true with a digital image forming system that forms a latent image on the photoconductive element in the form of dots by, e.g., selectively turning on a beam spot or turning it off in accordance with an image signal.

Background contamination described above is ascribable to the deterioration of the chargeability of the photoconductive element, which is ascribable to the repeated operation of the element, as known in the art. Specifically, when a charging system using a scorotron charger or similar corona discharger, charge roller or similar charging means charges the photoconductive element, it generates ozone, nitrogen oxides (NOx) and other produces due to discharge and deteriorates the photoconductive layer of the element. Moreover, the thickness of the photoconductive layer decreases due to mechanical hazards occurring in the apparatus.

There is an increasing demand for a photoconductive element having a thin photoconductive layer for enhancing image quality in an electrophotographic process. A thin photoconductive element prevents a latent image from spreading therein and thereby enhances the reproducibility of thin lines and fine dots. A thin photoconductive layer, however, lowers the chargeability of the photoconductive element, limiting a margin with respect to background contamination.

To cope with the decrease in the chargeability of the photoconductive element while reducing the thickness of the photoconductive layer, there has been proposed a method that adds additives having various antioxidant effects to the outermost layer of the element, which includes a charge holding layer. This kind of method is taught in, e.g., Japanese Patent Publication Nos. 50-33857 and 51-34736 and Japanese Patent Laid-Open Publication Nos. 56-130759, 57-122444, 62-105151, and 3-278061.

Japanese Patent Laid-Open Publication No. 6-003921, for example, proposes a system that directly injects a charge in the photoconductive element in order to protect the photoconductive layer from, e.g., ozone. Specifically, the system applies a voltage to a magnet brush or similar conductive member and causes the conductive member to inject a charge in a charge injection layer in contact therewith.

With the charge injection type of system described above, it is possible to effect substantially 1:1 charging with respect to the voltage applied to the conductive member. The system therefore reduces ozone and NOx more than conventional contact charging systems other than the charge inject ion type of system. Moreover, the system reduces the deterioration of the photoconductive layer and therefore reduces background contamination even when the photoconductive layer is thinned.

The charge injection type of system, however, has the following problems left unsolved. The photoconductive element includes a charge injection layer formed by dispersing tin oxide or similar metal oxide in resin. Therefore, irregular dispersion of the metal oxide, for example, causes the surface of the photoconductive element to be irregularly charged. Further, a charging member, a developing member and an image transferring member contact the photoconductive layer. The resulting stresses acting on the photoconductive layer deteriorate it and limit the durability of the photoconductive element. Moreover, when the charging member is implemented by a magnet brush, it charges the photoconductive element only in the region where magnetic particles forming the magnet brush contact the element. It follows that to uniformly charge the photoconductive element, it is necessary to increase the number of points where the magnetic particles contact the surface of the element.

Technologies relating to the present invention are also disclosed in, e.g., Japanese Patent Laid-Open Publication Nos. 6-230652, 7-168385, 7-239565, 8-69149, 9-211978,-9-329938, 11-72934, and 11-149204.

SUMMARY OF THE INVENTION

It is therefore an object of the present invention to provide an image forming apparatus producing a minimum of ozone and NOx and capable of charging a photoconductive element with a minimum of power.

It is another object of the present invention to provide an image forming apparatus free from background contamination despite the use of a thin photoconductive layer and stably operable over a long period of time.

It is a further object of the present invention to provide an image forming apparatus capable of enhancing the durability of a surface protection layer formed on an image carrier and including a charge injection layer, and uniformly charging the image carrier.

An image forming apparatus of the present invention includes a photoconductive element including a conductive support rotatably supported and a charge injection layer and a surface protection layer sequentially laminated on the conductive support. A charger includes a conductive body for injecting, when a preselected voltage is applied thereto, a charge in the charge injection layer in contact with the surface protection layer. A writing unit exposes the charged surface of the photoconductive element imagewise to thereby locally vary the potential deposited on the photoconductive element and electrostatically form a latent image. A developing unit develops the latent image to thereby produce a corresponding toner image. The toner image is transferred from the photoconductive element to a recording medium. Assuming that the charge injection layer has a thickness of D micrometers, and that the potential deposited on the surface of the photoconductive element by the conductive member is V volts in absolute value, then a ratio V/D is confined in a preselected range that does not contaminate the background of the photoconductive element.

BRIEF DESCRIPTION OF THE DRAWINGS

The above and other objects, features and advantages of the present invention will become more apparent from the following detailed description taken with the accompanying drawings in which:

FIG. 7 is a table listing experimental results relating to a relation between the thickness of a charge holding layer including in a photoconductive element and the potential of the element;

FIG. 17 is a table showing a relation between the mean particle size of magnetic particles and the uniformity of charging in relation to two-level writing;

FIG. 18 is a table showing a relation between the mean particle size of magnetic particles and the uniformity of charging in relation to multilevel-level writing.

DESCRIPTION OF THE PREFERRED EMBODIMENTS

Preferred embodiments of the image forming apparatus in accordance with the present invention will be described hereinafter.

First Embodiment

Figure 1:
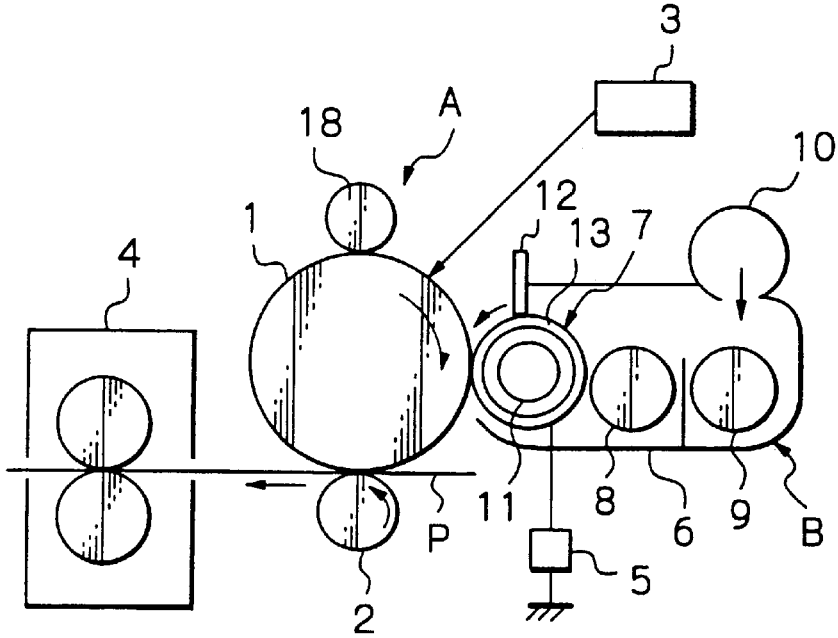
FIG. 1 is a view showing an image forming apparatus representative of a first and a second embodiment of the present invention.
Figure 2:
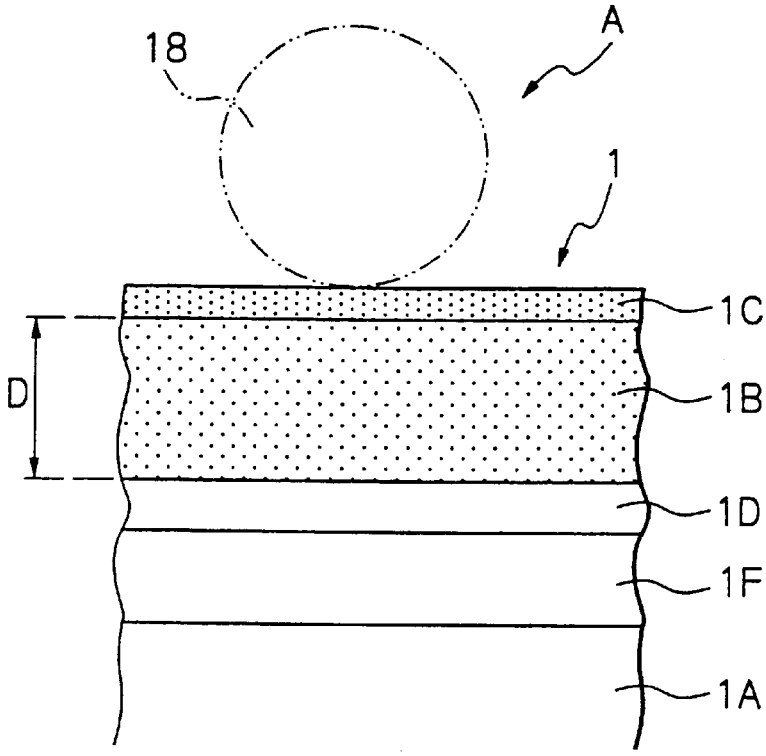
FIG. 2 is a fragmentary view showing a specific configuration of a photoconductive element included in the apparatus of FIG. 1.

Referring to FIG. 1 of the drawings, an image forming apparatus embodying the present invention is shown and includes a photoconductive element implemented as a drum 1. The drum 1 is rotatable clockwise, as indicated by an arrow in FIG. 1. As shown in FIG. 2, the drum 1 includes a conductive support or core 1A. In the illustrative embodiment, a charge holding layer or charge injection layer 1B and a surface protection layer 1C are sequentially laminated on the support 1A via an under layer 1F and a charge generation layer 1D.

As shown in FIG. 1, a charger A, a writing unit 3, a developing unit B, and a transfer roller 2 are arranged around the drum 1. The charger A includes a conductive member 18 to which a preselected voltage is applicable. The conductive member 18 contacts the surface protection layer 1C of the drum 1 in order to inject charge in the charge holding layer 1B, thereby uniformly charging the surface of the drum 1. The writing unit exposes the charged surface of the drum 1 imagewise so as to selectively vary the potential on the drum 1. As a result, a latent image is electrostatically formed on the drum 1. The developing unit B develops the latent image with toner to thereby produce a corresponding toner image. The transfer roller 2 transfers the toner image from the drum 1 to a paper sheet or similar recording medium.

In operation, while the charger A uniformly charges the surface of the drum 1, the writing unit 3 exposes the charged surface of the drum 1 in accordance with image data. At this instant, the writing unit 3 may scan the drum with a laser beam or expose it via a slit, as usual. As a result, a latent image corresponding to the image data is electrostatically formed on the drum 1. A bias voltage is applied from a power source 5 to a developer support member 7 included in the developing unit B. The bias voltage causes toner to be selectively transferred from the developer support member 7 to the latent image on the drum 1. Consequently, the latent image is transformed to a toner image.

A paper feeder, not shown, feeds a paper sheet P at a preselected timing. A registration roller pair, not shown, drives the paper sheet P toward a nip between the drum 1 and the transfer roller 2 such that the leading edge of the paper sheet P accurately meets the leading edge of the toner image. The transfer roller 2 transfers the toner image from the drum 1 to the paper sheet P. The paper sheet P with the toner image is separated from the drum 1 and conveyed to a fixing unit 4. The fixing unit 4 fixes the toner image on the paper sheet P. Subsequently, the paper sheet or print P is driven out of the apparatus body. Alternatively, when the operator of the apparatus has selected a duplex copy mode, the print P is turned over by refeeding means and again conveyed to the nip between the drum 1 and the transfer roller 2 so as to form a toner image on the other side thereof.

The developing unit B will be described more specifically hereinafter. The developing unit B includes a casing 6 accommodating the developer support member 7 and a front screw 8 and a rear screw 9 that are located behind the developer support member 7, as illustrated. The developer support member 7 faces the surface of the drum 1. A toner cartridge 10 storing fresh toner is removably mounted on the rear end portion of the casing 6.

The front screw 8 and rear screw 9 are isolated from each other by a partition disposed in the casing 6 and having an opening a its rear end, as viewed in FIG. 1, in the lengthwise direction of the casing 6. When the fresh toner is replenished from the toner cartridge 10 to the rear screw 9, the rear screw 9 in rotation conveys it to the rear side of the casing 6. During the conveyance, the toner is mixed with a developer existing in the casing 6. The resulting toner and developer mixture is transferred from the rear screw 9 to the front screw 8, which is also in rotation, via the opening of the partition. The front screw 8 conveys the mixture to the front, as viewed in FIG. 1, and causes it to deposit on the developer support member 7.

The developer support member 7 adjoins the drum or image carrier 1 and forms a developing region between it and the drum 1. The developer support member 7 includes a cylindrical nonmagnetic sleeve 13 formed of, e.g., aluminum, brass, stainless steel, resin or similar nonmagnetic material. A drive mechanism, not shown, causes the developer support member 7 to rotate counterclockwise, as indicated by an arrow in FIG. 1.

In the illustrative embodiment, the drum 1 has a diameter of 30 mm and rotates at a linear velocity of 125 mm/sec. The developer support member 1 has an outside diameter of 16 mm and rotates at a linear velocity of 312.5 mm/sec. Therefore, the linear velocity ratio of the sleeve 137 to the drum 1 is 2.5. It is to be noted that sufficient image density is achievable if the above linear velocity ratio is 1.1 or above. In the illustrative embodiment, the gap for development between the drum 1 and the developer support member 7 is selected to be 0.6 mm. The gap should preferably be less than thirty times of the particle size of the developer; otherwise, sufficient image density is not achievable.

A stationary magnet roller 11 is disposed in the developer support member 7 so as to form a magnetic field on the surface of the member 7. The magnetic field causes carrier contained in the developer to rise on the developer support member 7 in the form of a chain along the magnetic lines of force, which extend from the magnet roller 11. Toner also contained in the developer deposits on the carrier, forming a magnet brush.

The developer support member 7, carrying the magnet brush thereon, rotates in the direction shown in FIG. 1, conveying the developer to the developing region. A doctor blade 12 is positioned upstream of the developing region in the direction of rotation of the developer support member 7. The doctor blade 12 regulates the amount of the developer to be conveyed to the developing region. In the illustrative embodiment, a doctor gap between the doctor blade 12 and the developer support member 7 is selected to be 0.55 mm by way of example.

The magnet roller 11 has a single main pole and five auxiliary poles arranged thereon. The main pole causes the developer to rise in the developing region in the form of a chain. One auxiliary pole scoops up the developer onto the developer support member 7 while another auxiliary pole conveys the developer to the developing region. The other two auxiliary poles convey the developer in the region downstream of the developing region in the direction of rotation of the developer support member 7. While the magnet roller 11 has six magnets in total, only the main magnet actually contributes to development. The magnet roller 11 exerts a magnetic force of 85 mT or above, as measured on the developer support member 7. Experiments showed that such a magnet roller obviates defective images ascribable to, e.g., the deposition of the carrier.

Of course, the magnet roller 11 may be provided with eight or more poles for enhancing the scoop-up of the developer and the quality of a black solid image. For example, two additional poles may be positioned between the auxiliary poles and the doctor blade 12.

The configuration of the drum 1 will be described in detail hereinafter. In the illustrative embodiment, the drum 1 is implemented as a split-function type of photoconductive drum. As shown in FIG. 2, the charge generating layer 1D is formed on the conductive support 1A via the under layer 1F. The charge holding layer 1B and surface protection layer 1C are sequentially laminated on the charge generating layer 1D. The charge generating layer 1D and charge holding layer 1B constitute a photoconductive layer in combination.

The charge injection layer referred to herein is a layer capable of holding or conveying a charge that contributes to the potential of the drum 1. As for the laminate shown in FIG. 2, the charge injection layer refers mainly to the charge holding layer 1B having a film thickness D. When the drum 1 is implemented by a single layer, as distinguished from the above laminate, the charge injection layer will include the charge generating layer also. In any case, the charge generating layer 1D is far thinner than the charge holding layer 1B and has no substantial influence on the potential of the drum 1.

In the illustrative embodiment, the surface protection layer 1C contains a substance having a diamond-like carbon structure or an amorphous carbon structure containing hydrogen: More specifically, the surface protection layer 1C should preferably have diamond-like C—C connection having an SP hybridized orbital or may be implemented by a graphite-like film structure having an $SP^2$ hybridized orbital. Such a crystal line structure, which provides the surface protection layer 1C with mechanical strength and friction resistance, may be replaced with an amorphous substance so long as it implements comparable mechanical strength and friction resistance.

Further, the surface protection layer 1C contains an additive element or elements selected from, e.g., nitrogen, fluorine, boron, phosphor, chlorine, bromine and iodine. The volume resistance of the surface protection layer 1 is lower than that of the charge holding layer 1B and ranges from $10^9$ Ω.cm to $10^{12}$ Ω.cm. The layer 1 has a film thickness of 0.5 μm to 5 μm.

The surface protection layer 1C has a Knoop hardness of 400 kg/mm$^2$ or above. The surface protection layer 1C with such a rigid molecular structure and a smooth surface enhances the wear resistance of the surface of the drum 1. This is successful to extend the service life of the drum 1 despite the contact of various processing means including the charger A, developing unit B, transfer roller 2 and blades. In addition, by decelerating the deterioration of the drum 1, it is possible to preserve chargebility as well as image quality over a long period of time.

The conductive member 18 of the charger A contacts the drum 1 including the surface protection layer 1C, which is highly resistant to deterioration and has a small volume resistivity. Therefore, even if the voltage applied to the conductive member 18 is low, the conductive member 18 can charge the surface of the drum 1 to a potential necessary for the formation of a latent image. At this instant, the drum 1 is charged mainly by charge injection. Charge injection lowers the voltage required of the conductive member 18 and therefore causes a minimum of discharge to occur between the member 18 and the drum 1, effectively reducing or practically obviating ozone.

Assume that the charge holding layer or charge injection layer 1B has a thickness of D micrometers, and that the charge potential on the surface of the drum 1 charged by the conductive member 18 is V volts in absolute value. Then, in the illustrative embodiment, a ratio V/D is confined in a preselected range that protects the drum 1 from background contamination, as will be described specifically later.

Figure 3:
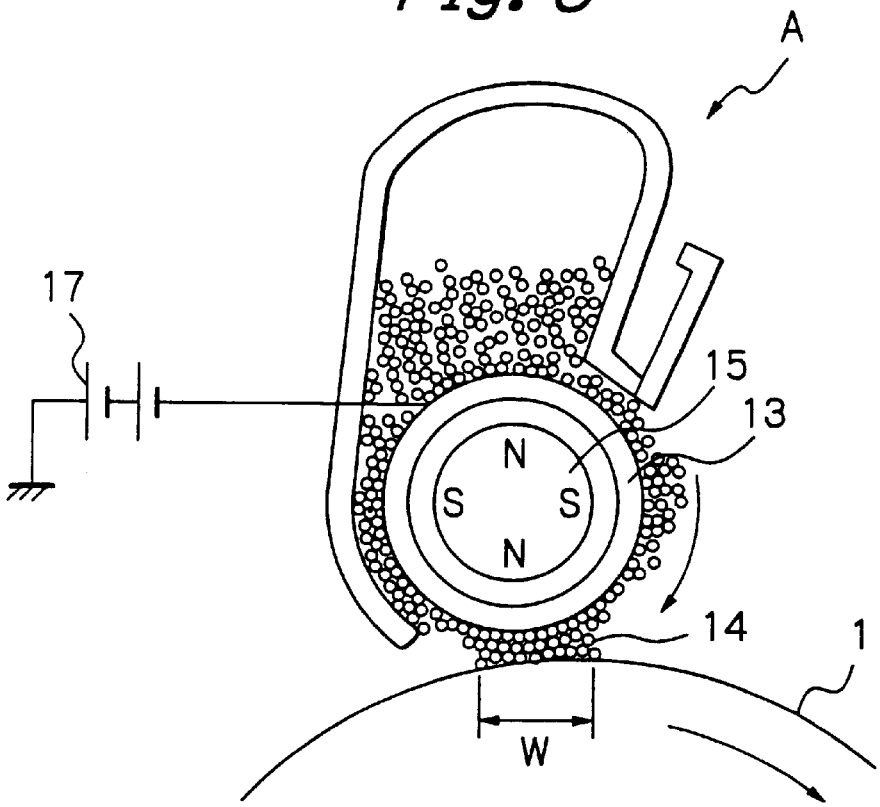
FIG. 3 is a view showing a specific configuration of a charger using a magnet brush.

Specific configurations of the charger A will be described hereinafter. FIG. 3 shows the charger A whose conductive member is implemented as a magnet brush. As shown, the charger A is made up of a nonmagnetic rotatable sleeve 13, a magnet roll 15 fixed in place within the sleeve 13, and a carrier 14 playing the role of a conductive member. The carrier 14 is magnetically retained on the sleeve 13 and forms a magnet brush contacting the drum 1. The magnetic force of the charger A should preferably be 400 gauss to 1,500 gauss, as measured on the surface of the sleeve 13, more preferably 600 gauss to 1,300 gauss.

The magnet roll 15 should preferably have two or more poles. It is preferable that such poles are positioned within a range of up to 20°, in the direction of rotation of the drum 1, from a line connecting the center of the charger A and that of the drum 1. Further, the peak of the poles should preferably be directed toward a range of up to 10° from the above line.

In the charger shown in FIG. 3, the sleeve 13 is spaced from the surface of the drum 1 by 0.6 mm. For this purpose, the distance between the magnet brush or charged carrier 14 and the drum 1 is set by a plate member located at the end in the lengthwise direction. In this condition, the charged carrier 14 contacts the surface of the drum 1 over a width W. The sleeve 13 is rotated in the same direction as the drum 1 relative to the stationary magnet roller 15. At the time of charging, voltage applying means 17 applies a desired voltage to the sleeve 13 with the result that a charge is injected in the surface protection layer 1C, FIG. 2, of the drum 1. The surface of the drum 1 is therefore charged to the same potential as the magnet brush.

For the carrier 14, use may be made of various materials including ferrite, magnetite and other conductive magnetic metals. To produce the carrier 14, a sintered carrier is reduced or oxidized to have a particular resistance to be described specifically later. As for the configuration of the carrier 14, fine conductive, magnetic particles may be mixed with a binder polymer and then molded into particles. If desired, the resulting conductive, magnetic fine particles may be coated with resin. In such a case, the resistance of the entire charged carrier 14 can be adjusted in terms of the content of carbon or similar conductive agent.

In the charger A shown in FIG. 3, the carrier 14 may have a mean particle size of 1 $\mu$m to 10 $\mu$m, preferably 5 $\mu$m to 50 $\mu$m for achieving both of chargeability and particle holding ability. To determine the mean particle size, use was made of an optical microscope or a scanning electronic microscope for selecting more than 100 particles at random. The volume particle distribution of the extracted particles was calculated in terms of the maximum horizontal chord length. Subsequently, a mean particle size of the carrier 14 was determined by using 50% of the resulting mean particle sizes.

The volume resistance of the carrier 14 should preferably be $10^{10}$ Ω.cm or below, more preferably $10^6$ Ω.cm to $10^9$ Ω.cm. Volume resistances higher than $10^{10}$ Ω.cm prevent a current necessary for charging from flowing and thereby deteriorate image quality due to short charge. To determine a volume resistance, after 2 grams of the charged carrier 14 has been filed in a tubular container whose bottom area is 288 $mm^2$, a voltage of 100 V is applied from the above and below. A volume resistance is calculated from the resulting current flowing through such a system and then normalized.

As for a magnetic characteristic, the carrier 14 should preferably have a saturation magnetization of 30 $Am^2$/kg or above, more preferably 40 $Am^2$/kg to 300 $Am^2$/kg. The holding force and residual magnetization are open to choice. A magnetization was measured by an oscillation magnetometer VSM-3S-15 available from Toei Kogyo K. K. under the application of 5 kiloersted; the amount of magnetization was determined to be the saturation magnetization. The carrier 14 may be directly supported by the magnet roll 15 without the intermediary of the sleeve 13, if desired.

Figure 4:
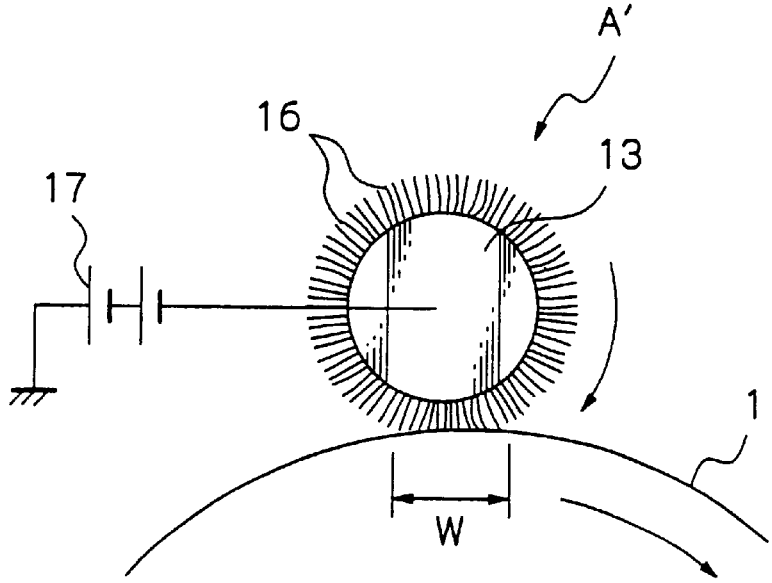
FIG. 4 is a view showing a specific configuration of a charger using a fur brush.

FIG. 4 shows another specific configuration of the charger. As shown, a charger, labeled A', uses a fur brush 16 as a conductive member contacting the drum 1. The fur brush 16, like the sleeve 13, is spaced from the surface of the drum 13 by 0.6 mm by the previously mentioned scheme. The fur brush 16 contacts the drum 1 over the width W while the nonconductive sleeve 13 rotates in the same direction as the drum 1, i.e., clockwise as viewed in FIG. 4. At the time of charging, the voltage applying means 17 applies a desired voltage to the sleeve 13 with the result that a charge is injected in the surface protection layer 1C, FIG. 2, of the drum 1. The surface of the drum 1 is therefore charged to the same potential as the magnet brush. The fur brush 16 has a length of 2 mm to 5 mm, a density of 50,000 to 200,000 bristles/$inch^2$, and a volume resistance of $10^{10}$ Ω.cm or below, preferably $10^6$ Ω.cm to $10^9$ Ω.cm.

Figures 5, 6:
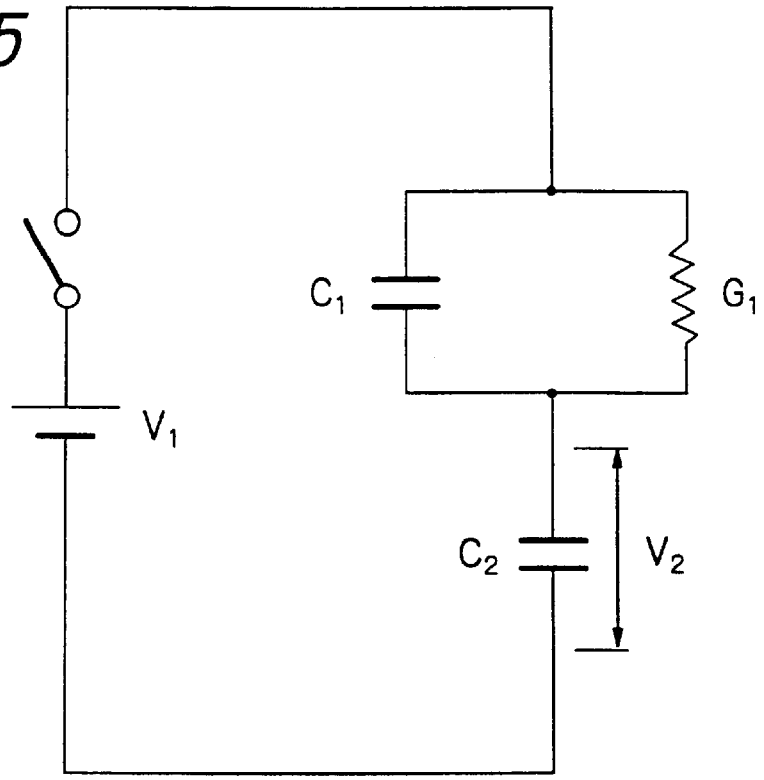
FIG. 5 is a circuit diagram showing an equivalent circuit representative of a charging operation available with the apparatus of FIG. 1.
FIG. 6 is a table listing specific numerical values of factors for providing a photoconductive element with a desired potential.

A series of experiments were conducted to determine the volume resistivity of the surface protection layer of the drum capable of charging the drum to required charge potential despite the application of a relatively low voltage to the conductive member of the charger. The results of experiments will be described hereinafter. FIG. 5 shows an equivalent circuit representative of the charging process. Various factors including the linear velocity of the drum 1 and the contact width W of the conductive member are set as follows:

X: linear velocity of the surface of the drum 1

W: contact width of the conductive member with the drum 1

$V_1$: voltage applied to the conductive member $T_1$: thickness of the surface protection layer 1C $T_2$: thickness of the charge holding layer 1B $C_1$: capacity of the surface protection layer (relative dielectric constant)

$C_2$: capacity of the charge holding layer 1B

R: volume resistivity of the surface protection layer 1C $G_1$: dielectric constant of the surface protection layer 1C (=W/(R.T1))

$V_2$: voltage of the charge holding layer 1B t: duration of contact of the conductive layer 18 (max. W/X)

Assume that the charge potential of the charge holding layer or charge injection layer 1B at the position where the conductive member contacts the drum 1 is $V_2$. Then, the charge potential $V_2$ is expressed as:

$$V_2 = V_1\left(1 - \frac{C_2}{C_1 + C_2} \ominus - \frac{G_1}{C_1 + C_2} t\right) \quad \text{Eq. (1)}$$

In the portion of the drum 1 remote from the conductive member, only a resistance G1 in the equivalent circuit of FIG. 5, i.e., the charge passed through the surface protection layer 1C is considered to contribute to the potential $V_2$ of the charge holding layer 1B. Assuming that the amount of the charge is Q, then it is produced by:

$$Q=C_2V_2-C_1(V_1-V_2)=(C_2+C_1)V_2-C_1.V_1 \quad \text{Eq. (2)}$$

In the above condition, the potential V of the drum is expressed as:

$$V=Q/C_2=(1+C_1/C_2)V_2-(C_1/C_2)V_1 \quad \text{Eq. (3)}$$

Generally, the practical potential of the drum 1 ranges from about −300 V to about −1,000 V. To confine the voltage V of the drum 1 in such a range, the various factors may be provided with specific numerical values listed in FIG. 6. In Example 1 shown in FIG. 6, the volume resistivity R of the surface protection layer 1C is selected to be $10^{10}$ Ω.cm. This volume resistivity R allows the drum 1 to be charged to −960 V substantially equal to −1,000 V applied to the conductive member, insuring a level at which a latent image can be surely formed. Another advantage achievable with such condition is as follows. A conventional charger using corona discharge produces a great amount of ozone because it needs a high-tension power source. Even a contact type charger usable when the drum 1 has a high resistance produces a small amount of ozone, and needs an AC voltage to be applied to its conductive member for obviating irregular charging. By contrast, as shown in FIG. 6, the illustrative embodiment applies a low voltage to the conductive member of the charger and therefore brings about no or little discharge. This not only reduces ozone more effectively, but also makes it needless to apply an AC voltage to the conductive member.

The influence of the thickness of the charge holding layer 1B and the charge potential of the surface of the drum 1 on an image was experimentally determined. For experiments, the drum 1 had a laminate structure while the charge holding layer 1B thereof had a thickness D. A value produced by dividing the charge potential V (absolute value) of the drum surface by the thickness D (volt/micrometer) was determined to be a field strength. FIG. 7 lists a relation between the field strength and the background contamination and reproducibility of thin lines.

During the above experiments, attention was paid to the thickness of the charge holding layer 1B and field strength (V/D), among others. FIG. 7 shows the results of estimation of background contamination and thin line reproducibility effected by the fall of chargeability of the drum 1, which is derived from a decrease in the thickness of the charge holding layer 1B. It is to be noted that background contamination ranks shown in FIG. 7 were determined by eye. As shown in FIG. 7, background contamination was dependent on the field strength (V/D). Specifically, when the field strength exceeded 40 V/μm, dielectric breakdown locally occurred in the photoconductive layer including the charge holding layer 1B and rendered an image defective, as indicated by crosses in FIG. 7. Particularly, when the field strength exceeded 45 V/μm, background contamination was noticeable. The drum 1 could not be charged at all when the field strength exceeded 90 V/μm.

Generally, a decrease in field strength translates into a decrease in charge transporting ability and therefore in photosensitivity, as well known in the art. FIG. 7 also proves that when the field strength acting on the drum 1 is 12 V/m or below, the photosensitivity of the drum 1 decreases and obstructs the drop of the potential in the exposed portion, resulting in short image density. The film thickness D in such a condition was 50 μm.

When the thickness D of the charge holding layer 1B was between 20 μm and 40 μm, images were scarcely defective and achieved sufficient density. As a result, the reproducibility of thin lines and fine dots was improved. Thin line reproducibility was not dependent on the field strength, but dependent on the thickness D of the charge holding layer 1B; the reproducibility was extremely poor when the thickness D was 50 μm or above.

The results of experiments described above teach that the field strength (V/μm) remarkably reduces background contamination when lying in the range of from 12 V/μm to 40 V/μm, and that the thickness D of the charge holding layer 1B is extremely effective when lying in the range of from 15 μm to 40 μm.

Second Embodiment

An alternative embodiment of the present invention will be described hereinafter in which the developing unit B, FIG. 1, plays the role of cleaning means for removing residual toner form the drum 1 at the same time. Because this embodiment is also practicable with the construction shown in FIG. 1, identical structural elements are designated by identical reference numerals.

In the illustrative embodiment, the charger A charges the toner left on the drum 1 after image transfer to substantially the same polarity as the drum 1. The developing unit B collects, with the bias for development, the toner charged by the charger A. In this sense, the illustrative embodiment implements a cleaner-free image forming apparatus.

In an electrophotographic image forming apparatus, the charging characteristic of toner sometimes varies during image transfer due to the kind of a recording medium or the voltage and current applied. It follows that substantial part of toner left on the drum 1 after image transfer has been charged to polarity opposite to one deposited at the time of development. For example, in the illustrative embodiment, the toner is negatively charged at the time of development, so that much of the toner left on the drum 1 after image transfer has been charged to positive polarity.

In the illustrative embodiment, when the surface of the drum 1 where the residual toner inverted in polarity is present passes the charger A, the charger A uniformly charges the surface, including the toner, to a preselected negative potential that is the expected polarity. The drum 1 conveys the negatively charged toner to the developing unit B. At this instant, the charge potential of the drum 1 is −960 V while the charge potential of the exposed portion of the drum 1 is −150 V.

A DC voltage of −600 V is applied to the developer support member 7 of the developing unit B. As a result, the developer support member 7 collects the residual toner present in the unexposed area or non-image area of the drum 1. The toner present in the exposed area or image area of the drum 1 remains on the drum 1, so that new toner is deposited thereon by the developer support member 7.

The illustrative embodiment is desirably practicable with spherical toner particles that scarcely remain on the drum 1 after image transfer. This kind of toner particles have high fluidity. This, coupled with a high parting ability between toner particles or from the drum 1, promotes efficient image transfer.

When use is made of the charger A shown in FIG. 3 and including a magnet brush, much residual toner is apt to enter the charger. The spherical toner, which has an inherently high image transfer efficiency, reduces the amount of toner to enter the charger A and thereby protects the magnet brush from deterioration.

As stated above, the cleaner-free image forming apparatus does not need a blade or similar exclusive cleaner assigned to the residual toner and is therefore small size and low cost. In addition, the blade or similar cleaner would cause the surface protection layer 1C of the drum 1 to wear.

While the first and second embodiments each includes image transferring means that applies a voltage to the transfer roller 2 for transferring a toner image from the drum 1 to a recording medium, the charging means may be replaced with, e.g., a charger using discharge. Further, a belt-like or tube-like intermediate image transfer member may be interposed between the drum 1 and a recording medium, if desired.

As stated above, the first and second embodiments have the following unprecedented advantages (1) through (4).

(1) Assume that the charge injection layer of a photoconductive element is D micrometers thick, and that the surface of the element charged by the conductive member of a charger is V volts. Then, a ratio V/D is confined in a range that does not bring about background contamination that would result in defective images. It follows that even when the thickness of the charge injection layer is made thin, defective images are obviated due to no background contamination.

(2) If the charge injection layer is 15 micrometers to 40 micrometers thick, the reproducibility of thin lines and dots, among others, can be desirably enhanced.

(3) When the conductive member of the charger is implemented by a magnet brush or a fur brush, contact injection type of charging is usable for protecting the photoconductive layer of the photoconductive element from deterioration ascribable to ozone, NOx and other products. This successfully extends the service life of the photoconductive element.

(4) The charger uniformly charges toner left on the photoconductive element after image transfer to substantially the same potential as the element. A developing unit bifunctions as cleaning means for removing, with a bias for development, the toner whose potential is substantially the same as the potential of the unexposed portion of the photoconductive element. This obviates the need for cleaning means that is mechanically hazardous for the photoconductive element, and further extends the life of the element.

Third Embodiment

Figure 8:
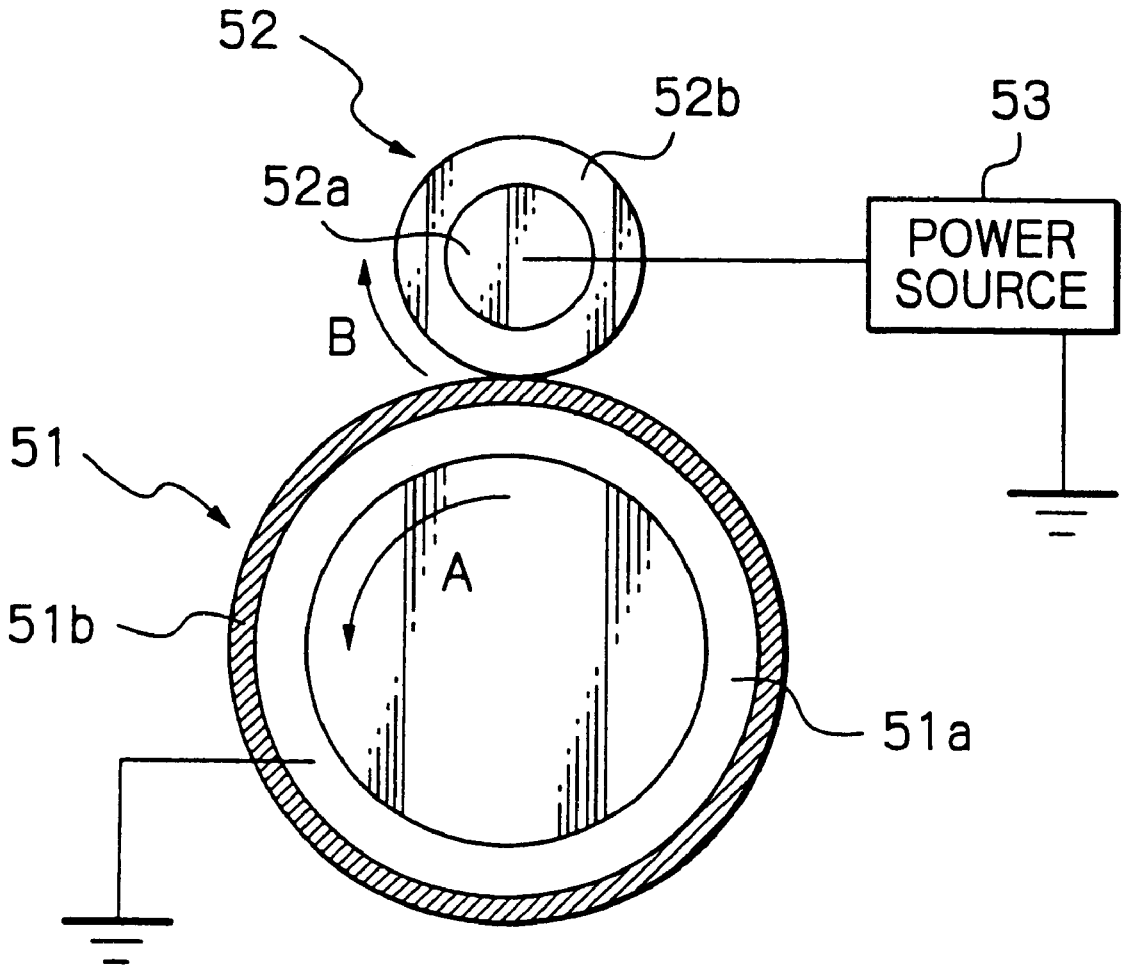
Fig. 8 PRIOR ART
FIG. 8 is a view showing a conventional contact type charger together with a photoconductive element implemented as a drum.

To better understand another alternative embodiment of the present invention, brief reference will be made to a conventional contact type charger, i.e., a charger of the type charging a photoconductive element by being applied with a voltage with a conductive member thereof contacting the element. As shown in FIG. 8, this type of charger includes a charging member 52 contacting a photoconductive drum, which is also implemented as a drum 51. The charging member 52 is implemented as a roller having an axial length of, e.g., about 300 mm and an outside diameter of about 5 mm to 20 mm. The charging member 52 is made up of a conductor or core 52*a* and an elastic layer 52*b* formed on the conductor 52*a*. The drum 51 has an axial length of, e.g., about 300 mm and an outside diameter ranging from 30 mm to 80 mm. The drum 51 is made up of a conductor or support 51*a* and a photoconductive layer 51*b* formed thereon.

The drum 51 rotates in a direction indicated by an arrow A while causing the charging member 52 to rotate in a direction indicated by an arrow B. The elastic layer 52*b* of the charging member 52 has a resistivity of $10^7$ Ω.cm to $10^9$ Ω.cm. A 10 μm to 20 μm thick surface protection layer may be formed on the surface of the elastic layer 52*b*. A DC voltage of −1.0 kV to −1.5 kV is applied from a power source 53 to the charging member 52 so as to charge the drum 51.

In the charger shown in FIG. 8, discharge occurs in the gap around the nip where the drum 51 and charging member 52 contact each other, charging the surface of the drum 51. Discharge in air, however, produces ozone, NOx and other harmful products although the amount of such products is smaller than when a corona discharger is used.

Figure 9:
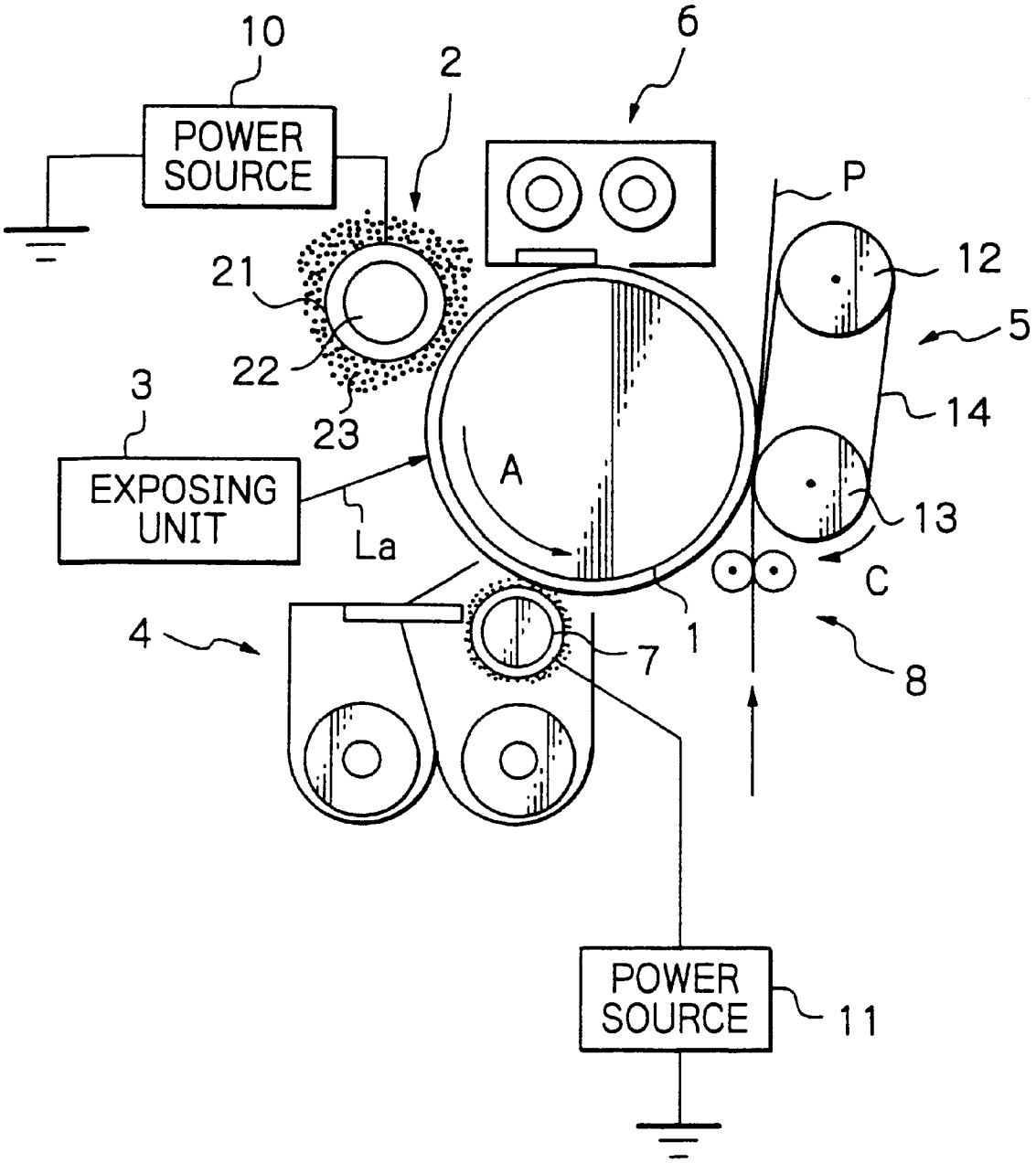
FIG. 9 is a view showing a third embodiment of the present invention.

FIG. 9 shows the third embodiment of the present invention. Reference numerals used in the this embodiment are independent of the reference numerals use din the previous embodiments and therefore do not always designate identical reference numerals. As shown, an image forming apparatus includes a photoconductive element or image carrier implemented as a drum 1. A charger 2 using a magnet brush, an exposing unit 3, a developing unit 4, an image transfer unit 5 and a cleaning unit 6 are arranged around the drum 1.

The drum 1 rotates at a peripheral speed of 100 mm/sec in a direction indicated by an arrow in FIG. 9. The charger 2 includes a sleeve 21 carrying magnetic particles 23 in the form of a magnet brush thereon. A power source 10 applies a voltage to the sleeve 21 with the result that the surface of the drum 1 is charged by charge injection. A magnet roll 22 is disposed in the sleeve 21 of the charger 2 so as to magnetically retain the magnetic particles, or charging member, on the sleeve 21. The drum 1 includes a surface protection layer 1*d* (see FIG. 10). While the magnetic particles 23 are held in contact with the surface protection layer 1*d*, the power source 10 applies the voltage to the sleeve 21.

The exposing unit 3 electrostatically forms a latent image on the charged surface of the drum 1 in accordance with image data representative of a desired document image, as represented by an arrow La. For this purpose, the exposing unit 3 may scan the drum 1 with a laser beam or expose it via a slit. In the illustrative embodiment, the exposing unit 3 uses a laser diode and causes a polygonal mirror to steer a laser beam issuing from the laser diode toward the drum 1, although not shown specifically.

The developing unit 4 includes a developing sleeve 7, a two-ingredient type developer, and a power source 11 and develops the latent image formed on the drum 1 with toner for thereby producing a corresponding toner image. In the illustrative embodiment, a power source 11 applies a voltage of −0.4 kV to the sleeve 7 so as to develop the portion of the drum 1 exposed by the exposing device 3. As a result, the latent image is transformed to the toner image by reversal development.

The image transfer unit 5 includes a belt 14 passed over two rollers 12 and 13 and capable of running in a direction indicated by an arrow C in FIG. 9. A power source, not shown, applies a voltage to the belt 14 so as to transfer the toner image from the drum 1 to a paper sheet P fed from paper feeding means, not shown, that is arranged below the image forming section. The image transfer unit 5 is controlled by constant current control using, e.g., −20 μA.

The drum 1, charger 2 and developing unit 4 will be described more specifically later.

In operation, the drum 1 rotates in the direction A while the charger 2 uniformly charges the surface of the drum 1 to a potential of −0.5 V. The exposing unit 3 scans the charged surface of the drum 1 with the laser beam La at a preselected timing, thereby forming a latent image on the drum 1. When the drum 1 in rotation conveys the latent image to the developing unit 4, the sleeve 7 of the developing unit 4 causes toner to deposit on the latent image and produce a toner image.

A registration roller pair 8 once stops the movement of the paper sheet P fed from a paper feeder, not shown, and then drives it toward a nip between the drum 1 and the image transfer unit 5 at such a timing that the lading edge of the paper sheet P accurately meets the leading edge of the toner image. The belt 14 of the image transfer unit 5 cooperates with the drum 1 to nip and convey the paper sheet P upward, as viewed in FIG. 1. At this time, the toner image is transferred from the drum 1 to the paper sheet P. The paper sheet P with the toner image is separated from the drum 1 and then has the toner image fixed thereon by a fixing unit, not shown. Subsequently, the paper sheet or print P is driven out to a tray, not shown, mounted on the apparatus body. In the duplex copy mode, the print P is again fed to the image forming section by refeeding means not shown, as in the previous embodiment.

Figure 10:
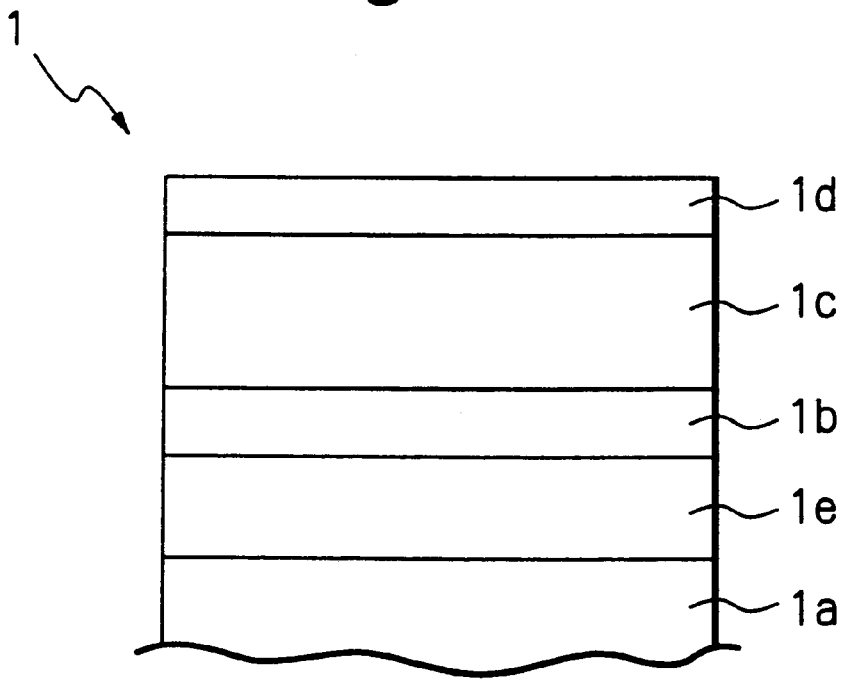
FIG. 10 is a view showing a photoconductive element included in the third embodiment and also implemented as a drum.

FIG. 10 shows a specific configuration of the drum 1. As shown, a plurality of layers are laminated on a conductive support or core 1*a*. Specifically, a charge generating layer 1*b* is formed on the base la via an under layer 1*e*. A charge transport layer 1*c* is formed on the charge generating layer 1*b*. Further, a surface protection layer 1*d* including a charge injection layer is formed on the charge transport layer 1*c*. While the charge generation layer 1*b* and charge transport layer 1*c* constitute a photoconductive layer in combination, the photoconductive layer may be implemented as either one of a single layer or a laminate.

The under layer 1*e* is 0.1 $\mu$m to 1.5 $\mu$m thick and formed of a suitable conventional material by coating. The material is open to choice so long as it can improve adhesion between the base la and the photoconductive layer, obviate moire, improve the coating characteristic of the overlying layer, and reduce residual potential. Examples of the material applicable to the under layer 1*e* are polyvinyl alcohol, casein, polysodium acrylate or similar water-soluble resin, copolymer nylon, methoxymethyl nylon or similar alcohol-soluble resin, polyurethane, melamine resin, alkyd-melamine resin, epoxy resin or similar setting resin forming a tridimensional mesh structure. If desired, fine powder of titanium oxide, silica, alumina, zirconium oxide, tin oxide, indium oxide or similar metal oxide or metal sulfide or metal nitride may be added to the above specific material. The under layer le may be formed by use of a suitable solvent and a suitable coating method. Also useful is a metal oxide layer implemented by a silan coupling agent, titanium coupling agent, chromium coupling agent or similar coupling agent and a sol-gel method. Furthermore, use may be made of $Al_2O_3$ to which anodization is applicable, or polyparaxylene or similar organic substance or $SnO_2$, $TiO_2$, IT, $CeO_2$ or similar inorganic substance provided to which a vacuum thin film forming method is applicable.

As for the photoconductive layer formed on the base la via the under layer 1*a*, either one of a Se series and an OPC series is usable. The OPC series will be described hereinafter.

The charge generating layer 1*b* of the drum 1 is implemented mainly by a charge generating substance or may be implemented by binder resin, if necessary. The charge generating substance may be selected from a group of inorganic substances and a group of organic substances. Inorganic substances include crystalline selenium, amorphous selenium, selenium tellurium, selenium-tellurium-halogen, and selenium-arsenic compounds.

On the other hand, organic substances usable as the charge generating substance include metal phthalocyanine pigments, metal-free phthalocyanine pigments and other phthalocyanine-pigments, azulenium pigments, azo pigments having a carbazole frame, azo pigments having a triphenylamine frame, azo pigments having a dipheylamine frame, azo pigments having dibenzothiophene frame, azo pigments having a fluorenone frame, azo pigments having an oxadiazole frame, azo pigments having a bisstylbene frame, azo pigments having a distyryloxadizole frame, azo pigments having a distyrylcarbazole frame, perylene pigments, anthraquinone or polycylic quinone pigments, quinoneimine pigments, diphenylmethane and triphenylmethane pigments, benzoquinone and naphthoquinone pigments, cyanine and azomethine pigments, indigoide pigments, and bisbenzimidasole pigments.

The above charge generating members may be used either singly or in combinati on. Binder resin, which may be applied to the charge generating layer 1*b*, is polyamide, polyurethane, epoxy resin, polyketone, polycarbonate, silicone resin, acrylic resin, polyvinyl butyral, plyvinyl formal, polyvinylketone, poly-N-vinyl carbazol or polyacrylamide by way of example. These binder resins may also be used either singly or in combination.

If desired, a charge transferring substance may be added. Further, the binder resin for the charge generating layer 1*b* may be replaced with a polymeric charge transferring substance.

Methods for forming the charge generating layer 1*b* are generally classified into vacuum thin film forming methods and casting methods using a solution dispersion. The thin film forming methods include vacuum deposition, glow discharge polymerization, ion plating, sputtering, reactive sputtering, and CVD and are applicable to the inorganic and organic substances. To form the charge generating layer 1*b* by the casting methods, any one of the organic and inorganic charge generating substances is dispersed in hydrofurane, dioxane, dichloroethane, butanone or similar solvent with or without a binder resin by a ball mill, sand mill or similar mill. The resulting solution is suitably diluted and then coated by, e.g., immersion, spray coating or bead coating. The charge generating layer 1*b* should preferably be about 0.01 $\mu$m to 5 $\mu$m, more preferably 0.05 $\mu$m to 2 $\mu$m.

The charge transfer layer 1*c* is used to hold charge and to cause charge generated in the charge generating layer 1*b* by exposure to migrate and join the above charge. To hold charge, the charge transfer layer 1*c* must have high electric resistance. In addition, to implement a high surface potential with the charge held, the charge transfer layer 1*c* must have a small dielectric constant and promote the migration of charge. To meet these requirements, the charge transfer layer 1*c* is formed of a charge transport substance and, if necessary, binder resin. For example, to form the charge transfer layer 1*c*, the charge transport substance and binder resin each are dissolved or dispersed in a suitable solvent, coated, and then dried. A plastisizer, an antioxidant, a leveling agent and others may be used in combination with the charge transport substance and binder resin.

The electron transport substance is either an electron transport substance or a hole transport substance, e.g., crylanyl, bromanyl, tetracyanoethylene or tetracyanoquinodimethane. Other charge transfer substances include 2,4, 7-trinitro-9-fluorenone, 2,4,5,7-tetranitro-9-fluorenone, 2,4,5,7-tetranitroxantone, 2,4,8-trinitrothioxyantone, 2,6,8-trinitro-4H-indeno[1,2-b]thiophene-4on, 1,3,7-trinitrodibenzothiophene-5,5-dioxide and other acceptor substances. These electron transport substances may be used either singly or in combination.

The hole transport substance is selected from a group of electron donor substances including oxazole derivatives, oxadiazole derivatives, imidazole derivatives, triphenylamine derivatives, 9-(p-diethylaminostyrylantrocene, 1,1-bis-(4-dibenzylaminophenyl) propane, styrylantracene, syrylpyrazol ine, phenylhydrozons, α-phenylstylpene derivatives, thiazole derivatives, triazole derivatives, phenazine derivatives, acryzine derivatives, benzofuran derivatives, benzoimidazole derivatives, and thiophene derivatives. These hole transport substances may be used either singly or in combination.

The polymeric charge transport substance has one of the structures (a) through (e) shown below:

(a) polymer having a carbazole cycle (b) polymer having a hydrozone structure (c) polysilirene polymer (d) other polymers The copolymer having a carbazole cycle is, e.g., poly-N-vinylcarbazole. Compounds of this kind are taught in, e.g., Japanese Patent Laid-Open Publication Nos. 50-82056, 54-9632, 54-11737, 4-175337, 4-183719 and 6-234841.

Polymers having a hydrazone structure are compounds taught in, e.g., Japanese Patent Laid-Open Publication Nos. 57-78402, 61-20953, 61-296358, 1-134456, 1-179164, 3-180851, 3-180852, 3-50555, 5-310904, and 6-234840.

Polyxyrene polymers are compounds taught in, e.g., Japanese Patent Laid-Open Publication Nos. 63-285552, 1-88461, 4-264130, 4-264131, 4-264132, 4-264133, and 4-289867.

Polymers having a trianylamine structure include N,N-bis(4-methylphenyl-4-aminoplystyrene and are taught in, e.g., Japanese Patent Laid-Open Publication Nos. 1-134457, 2-282264, 2-304456, 4-133065, 4-133066, 5-40350, and 5-202135.

The other polymers include a formaldehyde condensation polymer of nitropyrene and are disclosed in, e.g., Japanese Patent Laid-Open Publication Nos. 51-73888, 56-150749, 6-234836, and 6-234837.

The polymer having an electron donor radical and applicable to the drum 1 is not limited to the above-described polymers, but may be implemented by any one of copolymers of conventional monomers, block polymers, graft polymers and star polymers as well as bridge polymers having an electron donor radical taught in, e.g., Japanese Patent Laid-Open Publication No. 3-109406.

More useful polymeric charge transport substances are, e.g., polycarbonate, polyurethane, polyester and polyether having a triarylamine structure taught in, e.g., Japanese Patent Laid-Open Publication Nos. 64-1728, 64-13061, 64-19049, 4-11627, 4-225014, 4-230767, 4-320420, 5-232727, 7-56374, 9-127713, 9-222740, 9-26519, 9-211877, and 9-304956.

As for the binder resin applicable to the charge transport layer 1*c*, use may be made of polycarbonate (bisphenyl A type or bisphenol Z type), polyester, methacryalic resin, acrylic resin, polyethylene, vinyl chloride, vinyl acetate, polystyrene, phenol resin, epoxy resin, polyurethane, polyvinylidene chloride, alkyd resin, silicone resin, polyvinyl carbazole, polyvinyl butyral, polyvinyl formal, polyacrylate, polyacrylamide, and phenoxy resin. These binders may be used either singly or in combination.

The charge transport layer 1*c* should preferably have a thickness ranging from 5 μm to 100 μm. An antioxidant or a plastisizer customarily applied to rubber, plastics, fat and oil may be added to the charge transport layer 1*c*. Further, a leveling agent may be added to the charger transport layer 1*c*. The leveling agent may be any one of dimethylsilicone oil, methylphenylsilicone oil or similar silicone oil, a polymer having a perfluoroalkyl radical at its side chain, and an oligomer. Preferably, 0 to 1 part by weight of leveling agent should be contained for 100 parts by weight of binder resin.

Assume that the photoconductive layer is implemented as a single layer. Then, as for the casting method, a charge generating substance and a low molecule and a high molecule charge transport substance are, in many cases, dissolved or dispersed in a suitable solvent, coated, and then dried. The charge generating substance and charge transport substance may be implemented by any one of the previously stated substances. A plastisizer may be added to such substances. The binder resin, which may be used if necessary, may be implemented not only by the binder resins described in relation to the charge transport layer 1*c*, but also by the binder resins described in relation to the charge generating layer 1*b*. The single layer type of photoconductive layer should preferably be 5 μm to 100 μm thick.

The surface protection layer 1*d* laminated on the photoconductive layer has a diamond-like carbon structure or an amorphous carbon structure containing hydrogen. The surface protection layer 1*d* should preferably have C—C connection similar to diamond having an $SP^3$ orbital. Alternatively, the surface protection layer 1*d* maybe implemented as a film similar in structure to graphite having an $SP^2$ orbital or an amorphous.

A trace of any one of nitrogen, fluorine, boron, phosphor, chlorine, bromine and iodine may be added to the surface protection layer 1*d* as an additive element. The surface protection layer 1*d* should preferably have a volume resistance of $10^9$ Ω.cm to $10^{12}$ Ω.cm, a thickness of 0.5 μm to 5 μm, and a Knoop hardness of 400 kg/mm$^2$ or above. The light transmission of the surface protection layer should preferably be 50% or above of the wavelength of light used for exposure.

To form the surface protection layer 1*d*, use is made of a $H_2$, Ar or similar carrier gas mainly derived from a hydrogencarbonate gas (methane, ethane, ethylene, acetylene, etc.). For a gas that supplies the additive element, use is made of a gas capable of being gasified in a depressurized atmosphere and when heated. For example, a gas for supplying nitrogen may be implemented by $NH_3$ or $N_2$ while a gas for supplying fluorine may be implemented by $C_2F_6$ or $CH_3F$. A gas for supplying phosphor may be implemented by PH3 while a gas for supplying chlorine may be implemented by $CH_3Cl$, $CH_2Cl_2$, $CHCl_3CCl_4$. A gas for supplying bromine may be implemented by $CH_3Br$ while a gas for supplying iodine may be implemented by $CH_3I$. Further, a gas for supplying a plurality of additive elements maybe implemented by $NF_3$, $BCl_3$, BBr, $BF_3$, $PF_3$ or $PCl_3$.

The surface protection layer 1*d* is formed by any one of the above gases and by any one of plasma CVD, glow discharge decomposition, optical CVD and sputtering that deals with, e.g., graphite. Any one of such conventional methods may be used so long as it provides the surface protection layer Id with a desirable characteristic. To implement the surface protection layer id as a film whose major component is carbon, a method that belongs to plasma CVD, but having a sputtering effect, is disclosed in, e.g., Japanese Patent Laid-Open Publication No. 58-49609. This method does not have to heat a substrate and can form a film at a temperature as low as about 150° C. or below. It is therefore possible to form a protection layer even on an organic photoconductive layer whose heat resistance is low.

A specific procedure for fabricating the drum 1 shown in FIG. 10 will be described hereinafter. The conductive support la is formed of aluminum (Al) and provided with an outside diameter of 30 mm. The under layer or intermediate layer 1*e* is coated on the support 1*a* to a thickness of 4.0 μm, as measured after drying, by immersion. For this purpose, use is made of a coating liquid containing 6 parts of alkyd resin (Beccozole 1307-60-EL available from Dainihon Ink Kagaku Kogyo K.K), 4 parts of melamine resin (Super Beccamine also available from Dainihon Ink Kagaku Kogyo K.K.) and 200 parts of titanium oxide (CR-EL available from Ishihara Sangyo K.K.).

Subsequently, the under layer 1*e* is immersed in a coating layer containing a phthalocyanine pigment to form the charge generating layer 1*b* on the under layer 1*e* and then dried at 70° C. for 10 minutes. The coating liquid contains 5 parts of oxotitanium phthalocyanine pigment, 2 parts of polyvinyl buthyral (XYHL:UCC) and 80 parts of tetrhydrofurane.

Figure 11:
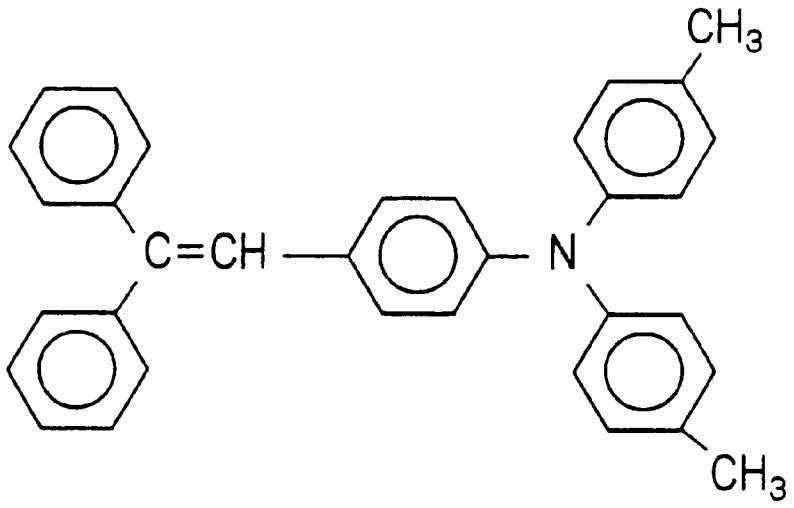
FIG. 11 shows a chemical formula representative of a low molecule, charge transfer substance used to prepare a coating layer that forms a charge transfer layer included in the drum.

The charge transport layer 1*c* is formed on the charge generating layer 1*b* by immersion in a coating liquid containing a low molecule charge transfer substance and drying effected at 120° C. for 25 minutes. The coating liquid contains 10 parts of bisphenol A polycarbonate (PanliteC 1400 available from Teijin), 10 parts of low molecule charge transfer substance having a structure shown in FIG. 11, and 100 parts of tetrahydrofurane.

Figure 12:
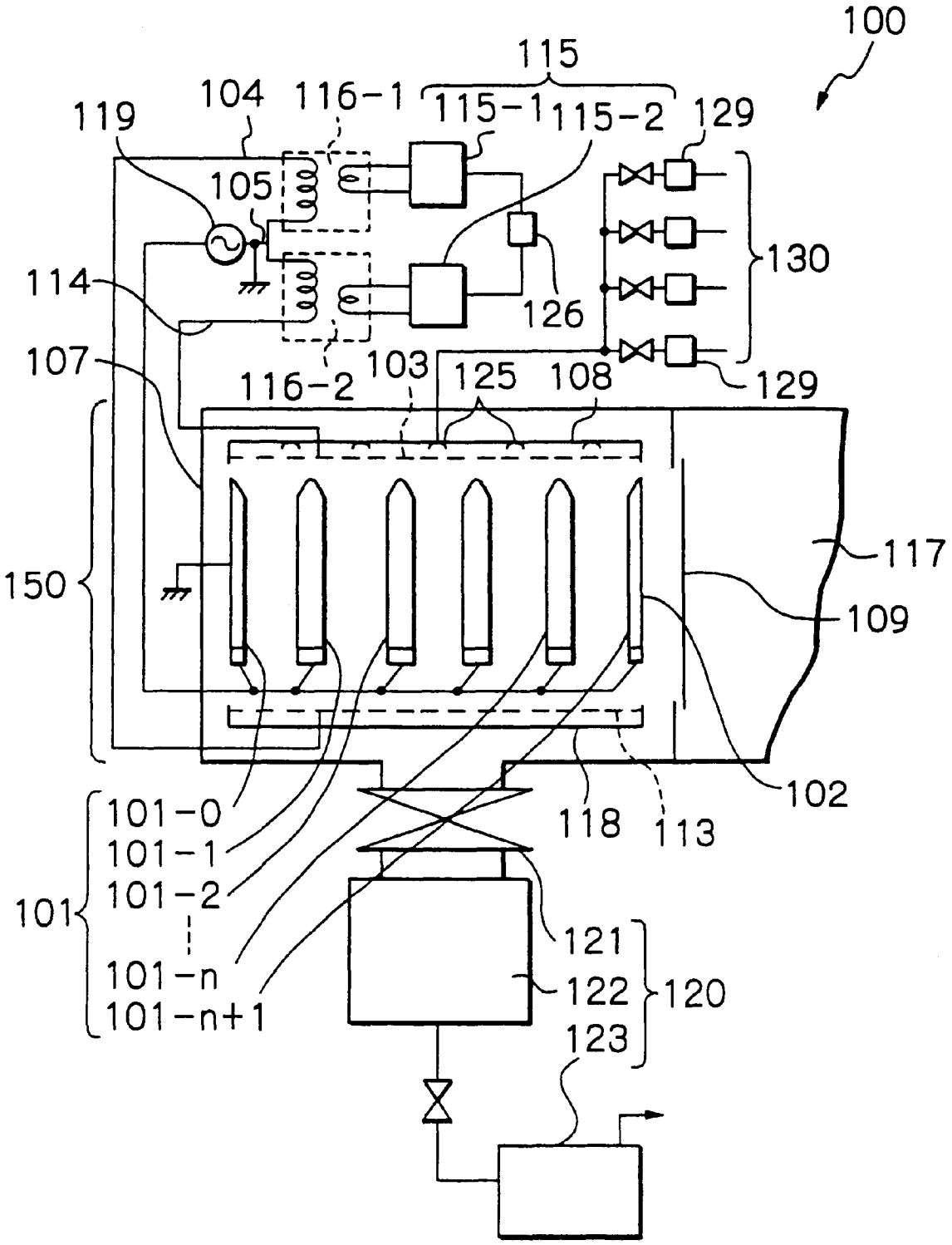
FIG. 12 is a circuit diagram showing a specific configuration of a plasma CVD (Chemical Vapor Deposition) system used to form a surface protection layer on the photoconductive element.

The drum 1 having the above layers sequentially laminated thereon is set in a plasma CVD system 100 shown in FIG. 12 in order to form the surface protection layer 1*d*. As shown, the plasma CVD system 100 includes a vacuum tank 107 accommodating a reaction vessel 150 therein. The reaction vessel 150 is made up of a frame-like structural body 102, hoods 108 and 118 covering opposite open ends of the structural body 102, and a pair of electrodes 103 and 113 respectively mounted on the hoods 108 and 118 and identical in configuration. The reaction vessel 150 has a square configuration shown in FIG. 13 or a hexagonal configuration shown in FIG. 14, as seen from the electrode side. The electrodes 103 and 113 each are implemented by a mesh formed of aluminum or similar metal.

Figure 13:
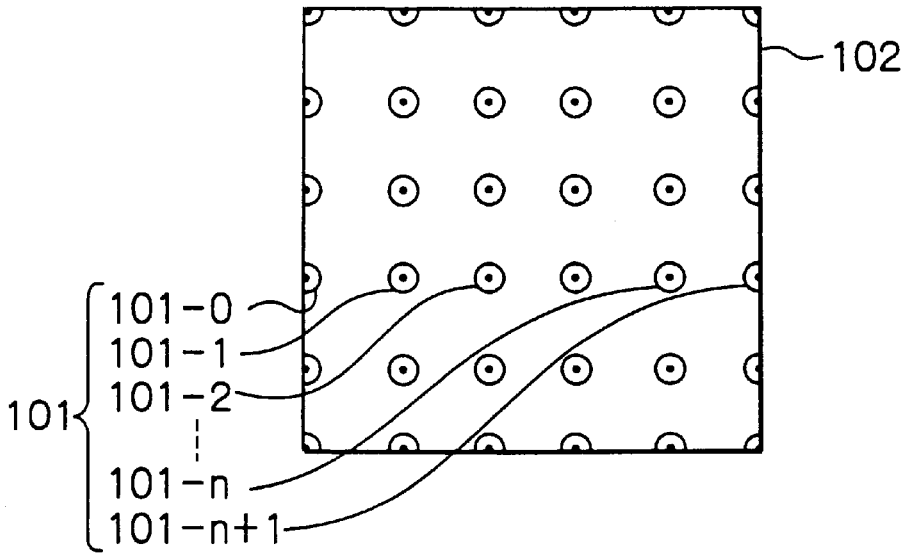
FIGS. 13 and 14 are plan views each showing a specific configuration of a reaction vessel included in the plasma CVD system.
Figure 14:
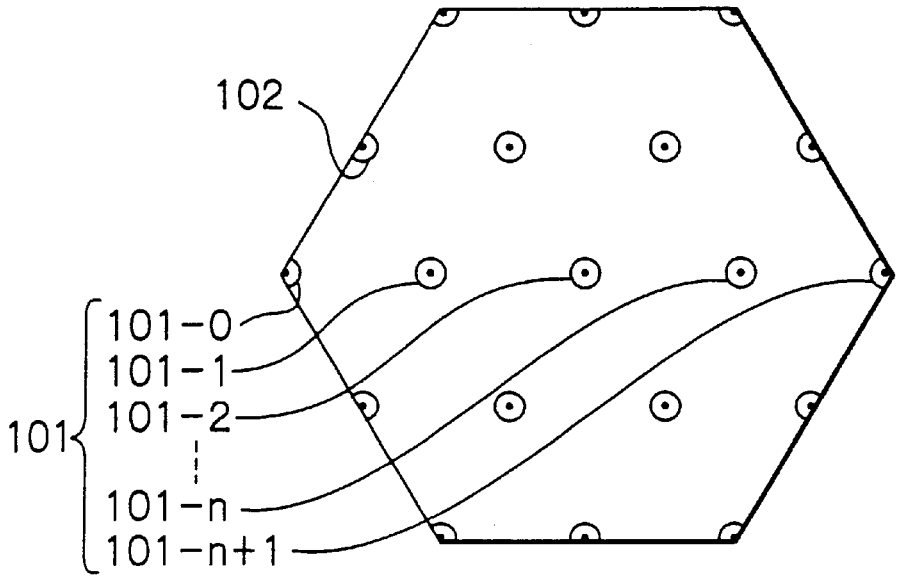

Containers storing different kinds of material gases each are connected to a particular gas line 130. Each material gas is admitted into the reaction vessel 150 via a particular gas line 130, a particular flow meter 129 and nozzles 125. Supports 101-1 through 101-*n* (collectively labeled 101) each carrying the previously stated photoconductive layer thereon are positioned in the structural body 102, as shown in FIG. 13 or 14. It is to be noted that the supports 101-1 through 101-*n* each play the role of a third electrode, as will be described specifically later.

A pair of power sources 115-1 and 115-2 (collectively labeled 115) apply a first alternating voltage to the electrodes 103 and 113, respectively. The first alternating voltage has a frequency of 1 MHz to 100 MHz. The power sources 115-1 and 115-2 are connected to matching transformers 116-1 and 116-2, respectively. A phase controller 126 controls the phases of the matching transistors 116-1 and 116-2 such that the phases are shifted by 180° or 0° from each other. The intermediate point 105 of the output side of the transformers 115-1 and 115-2 is held at the ground level. A power source 119 applies a second alternating voltage between the intermediate point 105 and the third electrodes 101 or holders electrically connected thereto. The second alternating voltage has a frequency of 1 kHz to 500 kHz. The first alternating voltage to be applied to the first electrode 103 and second electrode 113 is 0.1 kW to 1 kW when the frequency is 13.56 MHz. The second alternating voltage to be applied to the third electrodes or supports is about 100 W when the frequency is 150 kHz.

The plasma CVD system 100 was used to form the surface protection layer 1*d* having a thickness of 2.5 μm under the following conditions:

CH4 flow rate: 200 sccm

H2 flow rate: 100 sccm

Reaction Pressure: 0.05 torr

1st Alternative Voltage: 100 W, 13.56 MHz

Bias Voltage (DC Component): −200 V

Figure 15:
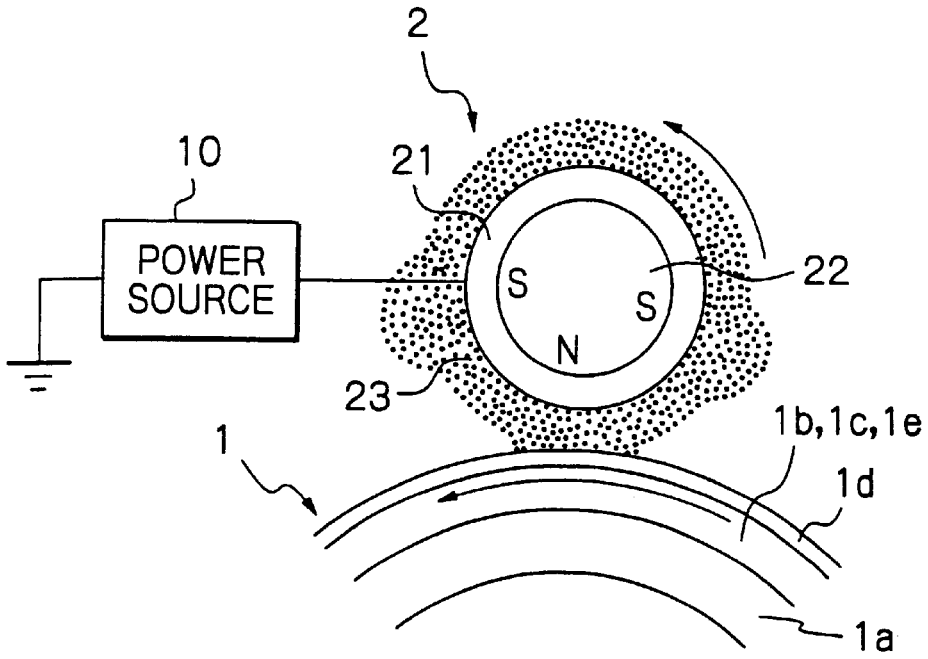
FIG. 15 is a view showing a magnet brush type charger included in the third embodiment together with part of the photoconductive drum.

Charge injection effected by the magnet brush type charger 2 will be described with reference to FIG. 15. The surface protection layer 1*d* is present on the top of the laminate formed on the drum 1 and serves as a charge injection layer, as stated with reference to FIG. 10. The charge injection layer plays the role of the electrode of a so-called capacitor. As shown in FIG. 15, while the magnet brush formed by the magnetic particles 23 is held in contact with the above electrode, a voltage is applied from the power source 10 to the sleeve 21 in order to inject a charge.

The magnet roll 22 is alternately magnetized to the S pole and N pole. The sleeve 21 surrounding the magnet roll 22 has a diameter of 15 mm and is formed of aluminum. The magnetic particles or charging members 23 are spherical ferrite particles having a mean particle size of about 50 μm and form an about 1.0 mm thick layer. The magnet roll 22 magnetically retains the magnetic particles 23 on the sleeve 21. The mean particle size should preferably lie in a range of 20 μm to 150 μm, as will be described specifically later. To determine the mean particle size, 300 magnetic particles 23 were selected at random in order to measure their outside diameters via a microscope, and a mean value of the outside diameters is calculated. The magnetic field formed by the magnet roll 22 has a peak flux density of about 0.1 mT at the position where the roll 22 faces the drum 1.

Ferrite forming the particles 23 may be replaced with manganese oxide, γ ferric oxide or similar material. The crux is that the particles 23 can form a magnet brush under the action of the magnet roll 22. In the illustrative embodiment, each particle 23 has a conductive surface layer. It is therefore possible to adjust the resistivity of the particle 23 on the basis of the surface layer. The resistivity of the particle 23 ranges from $10^5$ Ω.cm to $10^{10}$ Ω.cm. When the resisivity is $10^4$ Ω.cm or less, current leaks to pin holes existing in the drum 1 and renders charging in the surrounding portions defective while enlarges the pin holes. When the resistivity is $10^{11}$ Ω.cm or above, the magnet brush becomes insulative and makes it impossible to charge the drum 1.

The surface layer of the magnetic particle 23 is formed of, e.g., silicone resin provided with conductivity by the addition of an ionic compound or fluorine-contained resin. Further, the substance for providing the particle 23 with resistance is not limited to an ionic compound, but may be implemented by carbon or titanium oxide by way of example.

The sleeve 21 with the magnet brush formed by the magnet roll 22 is spaced from the surface of the drum 1 by a gap of 1.0 mm. The magnet brush contacts the drum 1, as shown in FIG. 15. The sleeve 21 moves in the opposite direction to the drum 1 at a peripheral speed (200 mm/sec) that is two times as high as the peripheral speed of the drum 1.

The surface of the sleeve 21 is roughed to 25 Rz by sand-blasting in order to surely convey the magnetic particles 23. The power source 10 applies a DC voltage of −500 V to the sleeve 21 in order to inject a charge in the surface protection layer 1*d* of ht drum 1. The above DC voltage may be replaced with an AC-biased DC voltage, if desired. Because the illustrative embodiment charges the drum 1 by charge injection, conditions that would cause discharge to occur between the magnet brush and the drum 1 is undesirable from the ozone standpoint.

Figure 16:
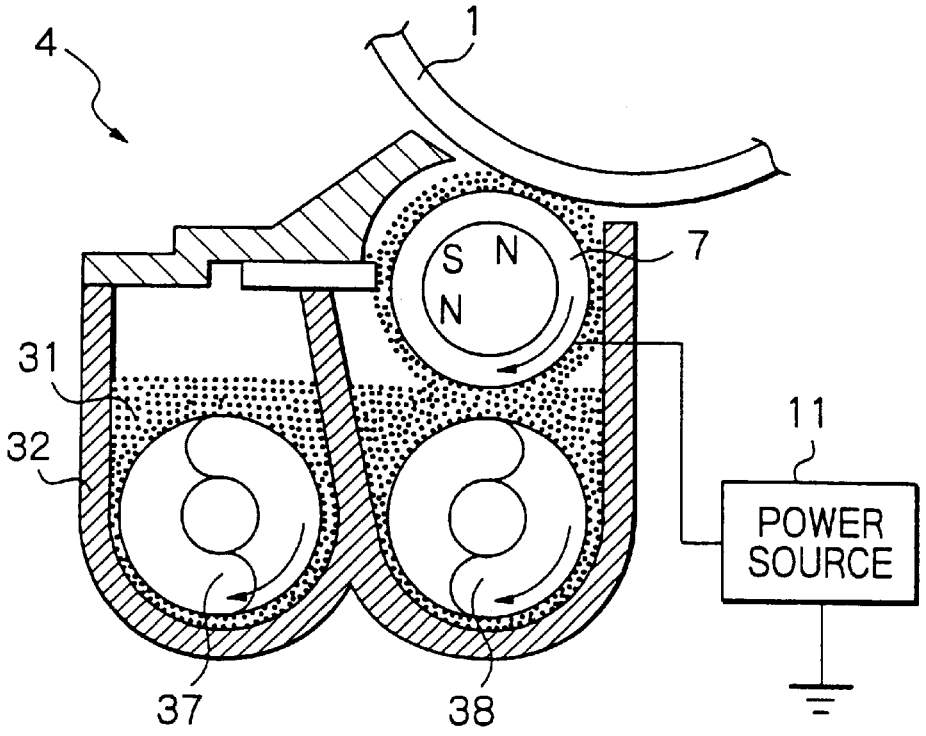
FIG. 16 is a view showing a developing unit also included in the third embodiment together with part of the photoconductive drum.

Reference will be made to FIG. 16 for describing the developing unit 4 using a two-ingredient type developer specifically. As shown, the developing sleeve 7 may have a diameter of 20 mm, a length of 320 mm and a thickness of 0.7 mm and may be formed of aluminum. 2 mm deep, axial grooves are formed in the surface of the sleeve 7 at a pitch of 1 mm, as measured in the circumferential direction. The developing sleeve 7 rotates at a peripheral speed of 250 mm/sec, which is 2.5 times as high as the peripheral speed of the drum 1.

A two-ingredient type developer 31 contains nonmagnetic toner that is chargeable to negative polarity and has a mean particle size of 7.5 μm. A carrier also contained in the developer 31 is implemented by magnetic particles having a mean particle size of 50 μm and a saturation magnetization of 60 emu/g. The developer 31 whose toner content is 5 wt % is stored in a casing 32 in an amount of 500 g. A pair of screws 37 and 38 are disposed in the casing 32 for conveying the developer 31 while agitating it. The screws 37 and 38 each have a diameter of 19 mm and a pitch of 20 mm. Drive means, not shown, cause the screws 37 and 38 to rotate at a speed of 200 rpm.

The power source 11 applies a bias of −400 V for development to the sleeve 7. The latent image formed on the drum 1 has a potential of −500 V in the non-image area and a potential of −50 V in the image area.

The two-ingredient type developer 31 may be replaced with a one-ingredient type developer, if desired.

While the illustrative embodiment has concentrated on the developing device 4 performing so-called contact type development, the developing device 4 may alternatively perform non-contact type development that maintains the developer spaced from the drum 1. Further, the bias applied to the developing sleeve 7 may be an AC-biased DC voltage.

A series of experiments were conducted to determine the durability of an image forming apparatus that was a conventional apparatus, but partly modified in accordance with the illustrative embodiment. Specifically, the wear of the drum 1 was examined after printing images on 100,000 paper sheets of size A4. For comparison, a conventional image forming apparatus including a charge injection type charger was also used. The conventional apparatus included a drum having a typical 2.5 μm thick surface protection layer that mainly consisted of $SnO_2$ and photosetting acrylic resin.

The experiments showed that the drum 1 of the illustrative embodiment, which had an about 4.0 μm thick intermediate layer on an aluminum support and an about 2.5 μm thick surface protection layer on the intermediate layer, wore only by 0.69 μm. By contrast, the conventional drum wore by 1.69 μm. That is, the drum of the illustrative embodiment achieves wear resistance about 2.4 times as high as that of the conventional drum.

To determine the uniformity of charging achievable with the magnet brush of the illustrative embodiment, the modified apparatus was actually operated to form a dot image having an area ratio of 25% (600 dpi; two-levels). The mean particle size of the magnet particles 23 was varied, as shown in FIG. 17. As shown, when the mean particle size exceeded 150 μm, the uniformity of charging was degraded and rendered image density irregular. When the mean particle size was smaller than 20 μm, it was difficult for the magnet roll 22 to retain the magnetic particles 23. As a result, the particles 23 deposited on the drum 1, i.e., flew about and rendered images defective. It follows that if the particles 23 have a mean particle size between 20 μm and 150 μm, a uniform image density is achievable while defective images can be obviated.

Further, to determine reproducibility of multilevel writing (600 dpi; four levels), an image with an area ratio of 100% and a ¼ value was written in order to estimate the uniformity of the image. As shown in FIG. 18, by varying the mean particle size, it was found that non-uniformity corresponding to the particle size of the magnetic particles 23 appeared in the image, as indicated by crosses.

More specifically, when the mean particle size of the particles 23 was 50 μm or less, which is the same as the particle size of the carrier for development, image irregularity did not vary from a period of about 50 μm. However, when the mean particle size exceeded 50 μm, image irregularity was noticeable. It is therefore preferable that the mean particle size of the magnetic particles 23 be smaller than the mean particle size of the carrier for development (magnetic particles).

Fourth Embodiment

Figure 19:
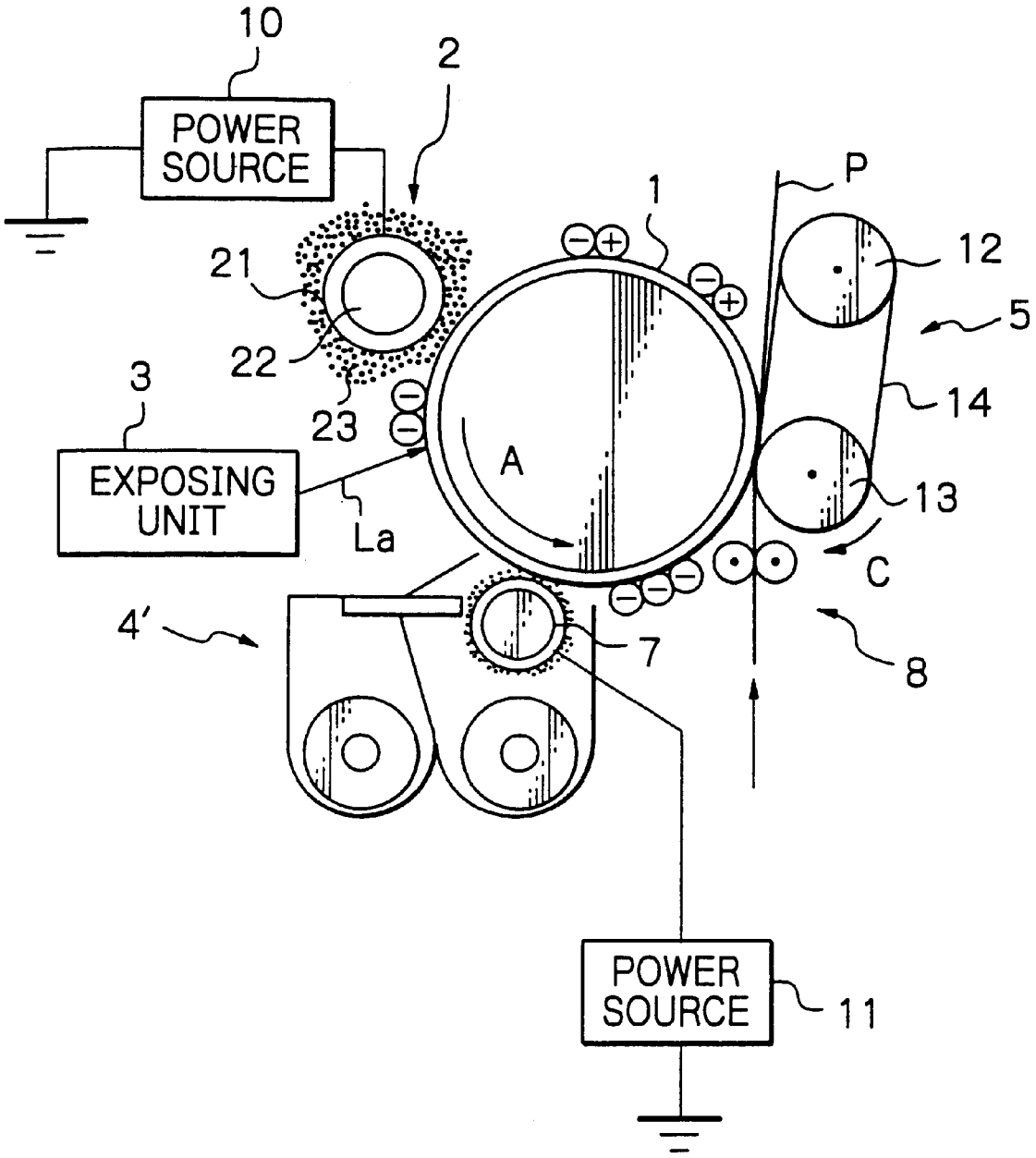
FIG. 19 is a view similar to FIG. 9, showing a fourth embodiment of the present invention.

FIG. 19 shows a fourth embodiment of the image forming apparatus in accordance with the present invention. In FIG. 19, structural elements identical with the structural elements shown in FIG. 9 are designated by identical reference numerals and will not be described specifically in order to avoid redundancy. As shown, the apparatus includes a developing unit 4' constructed to develop a latent image formed on the drum 1 and to collect the toner left on the drum 1 after image transfer at the same time. That is, the developing unit 4' has not only a developing function, but also a cleaning function.

Specifically, the image transfer unit 5 charges the paper sheet P to polarity opposite to the polarity of the toner. The toner moves toward the paper sheet P due to a Coulomb's force. At this instant, it is likely that the charge deposited on the paper sheet P is partly injected into the toner and charges the toner to polarity opposite to the expected polarity. Consequently, the toner left on the drum 1 after image transfer is a mixture of particles charged to negative of regular polarity and particles charged to positive or opposite polarity. In light of this, in the illustrative embodiment, the charger 2 serves to correct the polarity of the toner left on the drum 1 after image transfer to the regular negative polarity. The toner so corrected in polarity is conveyed to the developing unit 4' by the drum 1 rotating in a direction indicated by an arrow A. The developing unit 4' then collects the toner due to a potential difference between the drum 1 and the bias applied to the sleeve 7.

As stated above, the third and fourth embodiments of the present invention achieve various unprecedented advantages, as enumerated below.

(1) An image carrier includes a surface protection layer having a diamond-like structure or an amorphous carbon structure containing hydrogen. The surface protection layer therefore achieves improved wear resistance and noticeably improves the durability of the image carrier.

(2) The surface protection layer with the above structure has its resistance adequately lowered, so that a charge deposited on the surface protection layer is adequately scattered. Therefore, even when magnetic particles have a relatively large size, the image carrier can be uniformly charged. In addition, charge injection is successful to reduce irregularity in the potential difference between the magnetic particles and the image carrier. It follows that even when the magnetic particles have a relatively small size, they scarcely deposit on the image carrier. Consequently, even if the mean particle size of the magnetic particles lies in a broad range of from 20 $\mu$m to 150 $\mu$m, even a halftone image implemented by two-level dots is free from irregularity.

(2) The mean particle size of the magnetic particles for charging is smaller than the mean particle size of magnetic particles (carrier) for development. This, coupled with the structure of the surface protection layer formed on the image carrier, makes the irregularity of charging of the image carrier and that of development substantially identical in pitch with each other. Generally, to stably reproduce tonality by one dot, multilevel writing, the portion where the magnetic particles and image carrier contact each other must be formed with as small a pitch as possible because such an image is more susceptible to the irregularity of charging than a two-level dot image. The illustrative embodiments solve this problem and enhance the reproducibility of photos and color images needling accurate tonality.

(4) The image carrier and charging member contact with each other at different peripheral speeds. This causes the point where the image carrier and magnetic carriers forming a magnet brush to move due to the difference in peripheral speed. It is therefore possible to reduce the portion where the magnetic part ices do not contact the image carrier, i.e., to enhance efficient charging. Consequently, a voltage to be applied to the charger can be made as low as the charge to deposit on the image carrier.

(5) The image carrier and charging member move in opposite directions relative to each other, as seen at the position where they contact each other, causing the point where the image carrier and magnetic particles contact to move. This is also successful to enhance efficient charging. In addition, the uncharged portion of the image carrier can be reduced even if the moving speed of the charging member is not so high, so that efficient charging is further promoted.

(6) The magnetic particles for charging each have a conductive surface layer and can have their resistivity easily confined in a medium range of from $10^4$ Ω.cm to $10^{11}$ Ω.cm. Such particles are therefore easy to produce.

(7) A developing device not only develops a latent image formed on the image carrier with toner, but also removes the toner left on the image carrier after image transfer to a recording medium. This obviates the need for exclusive cleaning means for the collection of the toner and thereby reduces the overall size of the apparatus and the number of parts.

(8) In a conventional cleaner-free apparatus, an image carrier is apt to deteriorate due to ozone, nitrogen oxides and other products ascribable to discharge. By contrast, the illustrative embodiments do not produce the above products because they effect charge injection in place of discharge. Moreover, the illustrative embodiments do not use, e.g., a cleaning blade that shaves the surface of an image carrier while cleaning it.

Various modifications will become possible for those skilled in the art after receiving the teachings of the present disclosure without departing from the scope thereof.

What is claimed is:

1. An image forming apparatus comprising:

an image carrier comprising a conductive support, at least a photoconductive layer formed on said conductive support, and a surface protection layer formed on said photoconductive layer and including a charge injection layer;

a charging member for charging said image carrier in contact with said surface protection layer when applied with a voltage; and a developing unit for developing a latent image formed on said image carrier with toner to thereby produce a corresponding toner image, wherein said surface protection layer has a diamond-like carbon structure or an amorphous structure containing hydrogen, wherein said developing unit develops the latent image with a magnet brush formed by magnetic particles for development, wherein said charging member comprises magnetic particles for charging having a mean particle size smaller than a mean particle size of said magnetic particles for development, wherein said surface protection layer has a volume resistance of $10^9$ Ω·cm to $10^{12}$ Ω·cm and a Knoop hardness of 400 kg/mm$^2$ or greater, and wherein a light transmission of the surface protective layer is 50% or more of a wavelength of light used for exposing the image carrier.

2. An apparatus as claimed in claim 1, wherein said image carrier and said charging member contact each other, and each moves at a particular linear velocity.

3. An apparatus as claimed in claim 2, wherein said image carrier and said charging member move in opposite directions to each other, as seen at a position where said image carrier and said charging member contact each other.

4. An apparatus as claimed in claim 3, wherein said magnetic particles for charging each have a conductive surface layer.

5. An apparatus as claimed in claim 4, wherein the developing unit bifunctions as a cleaning unit for collecting the toner left on said image carrier after a transfer of said toner image from said image carrier to a recording medium.

6. An apparatus as claimed in claim 3, wherein the developing unit bifunctions as a cleaning unit for collecting the toner left on said image carrier after a transfer of said toner image from said image carrier to a recording medium.

7. An apparatus as claimed in claim 2, wherein said magnetic particles for charging each have a conductive surface layer.

8. An apparatus as claimed in claim 7, wherein the developing unit bifunctions as a cleaning unit for collecting the toner left on said image carrier after a transfer of said toner image from said image carrier to a recording medium.

9. An apparatus as claimed in claim 2, wherein the developing unit bifunctions as a cleaning unit for collecting the toner left on said image carrier after a transfer of said toner image from said image carrier to a recording medium.

10. An apparatus as claimed in claim 1, wherein said magnetic particles for charging each have a conductive surface layer.

11. An apparatus as claimed in claim 10, wherein the developing unit bifunctions as a cleaning unit for collecting the toner left on said image carrier after a transfer of said toner image from said image carrier to a recording medium.

12. An apparatus as claimed in claim 1, wherein the developing unit bifunctions as a cleaning unit for collecting the toner left on said image carrier after a transfer of said toner image from said image carrier to a recording medium.

13. An image forming apparatus comprising:

image carrier means for carrying an image and comprising a conductive support, at least a photoconductive layer formed on said conductive support, and a surface protection layer formed on said photoconductive layer and including a charge injection layer;

charging means for charging said image carrier means in contact with said surface protection layer when applied with a voltage; and developing means for developing a latent image formed on said image carrier means with toner to thereby produce a corresponding toner image, wherein said surface protection layer has a diamond-like carbon structure or an amorphous structure containing hydrogen, wherein said developing means develops the latent image with a magnet brush formed by magnetic particles for development, wherein said charging means comprises magnetic particles for charging having a mean particle size smaller than a mean particle size of said magnetic particles for development, wherein said surface protection layer has a volume resistance of $10^9$ Ω·cm to $10^{12}$ Ω·cm and a Knoop hardness of 400 kg/mm$^2$ or greater, and wherein a light transmission of the surface protective layer is 50% or more of a wavelength of light used for exposing the image carrier means.

14. An apparatus as claimed in claim 13, wherein said image carrier means and said charging means contact each other, and each moves at a particular linear velocity.

15. An apparatus as claimed in claim 14, wherein said image carrier means and said charging means move in opposite directions to each other, as seen at a position where said image carrier means and said charging means contact each other.

16. An apparatus as claimed in claim 15, wherein said magnetic particles for charging each have a conductive surface layer.

17. An apparatus as claimed in claim 16, wherein said developing means bifunctions as cleaning means for collecting the toner left on said image carrier means after a transfer of said toner image from said image carrier means to a recording medium.

18. An apparatus as claimed in claim 15, wherein said developing means bifunctions as cleaning means for collecting the toner left on said image carrier means after a transfer of said toner image from said image carrier means to a recording medium.

19. An apparatus as claimed in claim 14, wherein said magnetic particles for charging each have a conductive surface layer.

20. An apparatus as claimed in claim 19, wherein said developing means bifunctions as cleaning means for collecting the toner left on said image carrier means after a transfer of said toner image from said image carrier means to a recording medium.

21. An apparatus as claimed in claim 14, wherein said developing means bifunctions as cleaning means for collecting the toner left on said image carrier means after a transfer of said toner image from said image carrier means to a recording medium.

22. An apparatus as claimed in claim 13, wherein said magnetic particles for charging each have a conductive surface layer.

23. An apparatus as claimed in claim 22, wherein said developing means bifunctions as cleaning means for collecting the toner left on said image carrier means after a transfer of said toner image from said image carrier means to a recording medium.

24. An apparatus as claimed in claim 13, wherein said developing means bifunctions as cleaning means for collecting the toner left on said image carrier means after a transfer of said toner image from said image carrier means to a recording medium.

* * * * *